US006401668B2

(12) United States Patent
Valcic

(10) Patent No.: US 6,401,668 B2
(45) **Date of Patent: *Jun. 11, 2002**

(54) IGNITION INHIBITING GAS WATER HEATER

(75) Inventor: Zoran Valcic, Chatswood (AU)

(73) Assignee: SRP 687 Pty. Ltd. (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/760,997

(22) Filed: Jan. 16, 2001

Related U.S. Application Data

(63) Continuation of application No. 09/376,099, filed on Aug. 17, 1999, now Pat. No. 6,196,164, which is a division of application No. 08/801,060, filed on Feb. 14, 1997, now Pat. No. 6,003,477, which is a continuation-in-part of application No. 08/762,400, filed on Dec. 9, 1996, now Pat. No. 6,295,951, which is a continuation-in-part of application No. 08/742,587, filed on Oct. 28, 1996, now abandoned, which is a continuation-in-part of application No. 08/626,844, filed on Apr. 3, 1996, now Pat. No. 5,797,355.

(30) Foreign Application Priority Data

| | | |
|---|---|---|
| Apr. 4, 1995 | (AU) | PN 2136 |
| Sep. 22, 1995 | (AU) | PN 5591 |
| Jul. 2, 1996 | (AU) | PO 0786 |

(51) Int. Cl.[7] ..... F22B 5/00
(52) U.S. Cl. ..... 122/14.31; 122/14.1; 122/504
(58) Field of Search ..... 122/14.31, 13.01, 122/14.1, 504, 504.1; 126/42; 431/22, 346, 354

(56) References Cited

U.S. PATENT DOCUMENTS

| | | | |
|---|---|---|---|
| 360,199 | A | 3/1887 | Boegler |
| 626,454 | A | 6/1899 | Brintnall |
| 736,153 | A | 8/1903 | Reynolds |
| 796,924 | A | 8/1905 | McCartney |
| 1,398,986 | A | 12/1921 | Warnock |
| 1,661,193 | A | 3/1928 | Newport |
| 1,692,839 | A | 11/1928 | Humphrey |
| 1,806,216 | A | 5/1931 | Plummer |
| 1,841,463 | A | 1/1932 | Barber et al. |
| 2,008,155 | A | 7/1935 | Ramsdell et al. |
| 2,036,136 | A | 3/1936 | Guarcello |
| 2,070,535 | A | 2/1937 | Hansen |
| 2,112,655 | A | 3/1938 | Morrow |
| 2,429,916 | A | 10/1947 | Belgau |

(List continued on next page.)

FOREIGN PATENT DOCUMENTS

| | | | |
|---|---|---|---|
| DE | 25 40 709 | A1 | 3/1977 |
| DE | 27 47 024 | B1 | 2/1979 |
| DE | 39 26 699 | A1 | 2/1991 |
| EP | 0 462 296 | A1 | 12/1991 |
| EP | 0 560 419 | A2 | 9/1993 |
| EP | 0 596 555 | A1 | 5/1994 |
| EP | 0 657 691 | A1 | 6/1995 |
| FR | 2 566 101 | | 12/1985 |
| JP | 60-134117 | A | 7/1985 |
| JP | 62-162814 | A | 7/1987 |
| WO | WO 94/01722 | | 1/1994 |

OTHER PUBLICATIONS

Flame traps—a technical note, S. K. Sarkar, Journal of Mines, Metals & Fuels, Jul. 1987.

*Primary Examiner*—Gregory Wilson
(74) *Attorney, Agent, or Firm*—Schnader Harrison Segal & Lewis LLP

(57) ABSTRACT

A water heater including a water container; a combustion chamber located adjacent the container, the combustion chamber having a floor portion with an opening; a conduit extending upwardly from and being substantially sealed to the opening; a burner located inside the combustion chamber; and a flame trap positioned across the conduit, the flame trap permitting ingress of air and/or extraneous gases into the combustion chamber and prevent egress of flames from the structure.

27 Claims, 21 Drawing Sheets

U.S. PATENT DOCUMENTS 2,479,042 A 8/1949 Gaines
2,499,636 A 3/1950 Finley
2,559,110 A 7/1951 Burwell
3,139,067 A 6/1964 Van Den Brock et al.
3,161,227 A 12/1964 Goss et al.
3,741,166 A 6/1973 Bailey
3,920,375 A 11/1975 Sanderson et al.
3,947,229 A 3/1976 Richter
4,039,272 A 8/1977 Elliott
4,080,149 A 3/1978 Wolfe
4,177,168 A 12/1979 Denny et al.
4,191,173 A 3/1980 Dedeian et al.
4,204,833 A 5/1980 Kmetz et al.
4,241,723 A 12/1980 Kitchen
4,480,988 A 11/1984 Okabayashi et al.
4,510,890 A 4/1985 Cowan
4,519,770 A 5/1985 Kesselring et al.
4,565,523 A 1/1986 Berkelder
4,639,213 A 1/1987 Simpson
4,641,631 A 2/1987 Jatana
4,742,800 A 5/1988 Eising
4,777,933 A 10/1988 Ruark
4,790,268 A 12/1988 Eising
4,817,564 A 4/1989 Akkala et al.
4,823,770 A 4/1989 Loeffler
4,863,370 A 9/1989 Yokoyama et al.
4,869,232 A 9/1989 Narang
4,872,443 A 10/1989 Ruark
4,893,609 A 1/1990 Giordani et al.
4,919,085 A 4/1990 Ishiguro
4,924,816 A 5/1990 Moore, Jr. et al.
4,960,078 A 10/1990 Yokoyama et al.
5,020,512 A 6/1991 Vago et al.
5,044,928 A 9/1991 Yokoyama et al.
5,085,205 A 2/1992 Hall et al.
5,197,456 A 3/1993 Ryno
5,205,731 A 4/1993 Reuther et al.
5,215,457 A 6/1993 Segastiani
5,240,411 A 8/1993 Abalos
5,246,397 A 9/1993 Petter
5,261,438 A 11/1993 Katchka
5,317,992 A 6/1994 Joyce
5,335,646 A 8/1994 Katchka
5,355,841 A 10/1994 Moore, Jr. et al.
5,368,263 A 11/1994 Harrison
5,385,467 A 1/1995 Sebastiani et al.
5,397,233 A 3/1995 Eavenson et al.
5,405,263 A 4/1995 Gerdes et al.
5,427,525 A 6/1995 Shukla et al.
5,435,716 A 7/1995 Joyce
5,448,969 A 9/1995 Stuart et al.
5,494,003 A 2/1996 Bartz et al.
5,511,516 A 4/1996 Moore, Jr. et al.
5,520,536 A 5/1996 Rodgers et al.
5,522,723 A 6/1996 Durst et al.
5,531,214 A 7/1996 Cheek
5,533,495 A 7/1996 Moore, Jr.
5,556,272 A 9/1996 Blasko et al.
5,575,274 A 11/1996 DePalma
5,588,822 A 12/1996 Hayakawa et al.
5,649,821 A 7/1997 Fogliani et al.
5,649,822 A 7/1997 Gertler et al.
5,674,065 A 10/1997 Grando et al.
5,791,298 A 8/1998 Rodgers
5,797,355 A 8/1998 Bourke et al.
5,797,358 A 8/1998 Brandt et al.
5,937,796 A 8/1999 Sebastiani
5,941,200 A * 8/1999 Boros et al. ..... 122/13.1
6,109,216 A 8/2000 Reynolds et al.

* cited by examiner

IGNITION INHIBITING GAS WATER HEATER

This application is a continuation of U.S. Ser. No. 09/376,099 filed Aug. 17, 1999, now U.S. Pat. No. 6,196,164; which is a divisional of U.S. Ser. No. 08/801,060, filed on Feb. 14, 1997, now U.S. Pat. No. 6,003,477; which is a continuation-in-part of U.S. Ser. No. 08/762,400 filed Dec. 9, 1996, now U.S. Pat. No. 6,295,951; which is a continuation-in-part of U.S. Ser. No. 08/742,587 filed on Oct. 28, 1996, now abandoned; which is a continuation-in-part of U.S. Ser. No. 08/626,844 filed Apr. 3, 1996 now U.S. Pat. No. 5,797,355.

FIELD OF THE INVENTION

BACKGROUND OF INVENTION

The most commonly used gas-fired water heater is the storage type, generally comprising an assembly of a water tank, a main gas burner to provide heat to the tank, a standing pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame. For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that they are also used for storage of other equipment such as lawn mowers, trimmers, snow blowers and the like. It is common for such machinery to be refueled in such locations.

There have been a number of reported instances of spilled gasoline and associated fumes being accidently ignited. There are many available ignition sources, such as refrigerators, running engines, electric motors, electric light switches and the like. However, gas water heaters have sometimes been suspected because they often have a pilot flame.

Vapors from spilt or escaping flammable liquid or gaseous substances in a space in which an ignition source is present provides for ignition potential. "Fumes," "extraneous gases" or "extraneous fumes" is sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like. Many inter-related factors influence whether a particular fuel spillage leads to ignition. These factors include, among other things, the quantity, nature and physical properties of the particular type of spilt fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges capable of enabling ignition are not reached given all the surrounding circumstances.

One surrounding circumstance is the relative density of the fumes. When a spilt liquid fuel spreads on a floor, normal evaporation occurs and fumes from the liquid form a mixture with the surrounding air that may, at some time and at some locations, be within the range that will ignite. For example, that range for common gasoline vapor is between about 3% and 8% gasoline with air, for butane between about 1% and 10%. Such mixtures form and spread by a combination of processes including natural diffusion, forced convection due to air current draughts and by gravitationally affected upward displacement of molecules of one less dense gas or vapor by those of another more dense. Most common fuels stored in households are, as used, either gases with densities relatively close to that of air (e.g., propane and butane) or liquids which form fumes having a density close to that of air, (e.g., gasoline, which may contain butane and pentane among other components is very typical of such a liquid fuel).

In reconstructions of accidental ignition situations, and when gas water heaters are sometimes suspected and which involved spilt fuels typically used around households, it is reported that the spillage is sometimes at floor level. It is reasoned that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of fumes being at or near floor level is the fact that many gas appliances often have their source of ignition at or near that level.

The invention aims to substantially lower the probability of ignition in typical fuel spillage circumstances.

SUMMARY OF THE INVENTION

The invention provides a gas water heater including a water container adapted to be heated by a gas burner. An enclosure surrounds the burner and the water container. The water heater has at least one opening adapted to allow air for combustion or extraneous fumes to enter the enclosure without igniting flammable extraneous fumes outside of the enclosure.

In another aspect the invention encompasses a water heater comprising a water container and a combustion chamber located adjacent the container. The combustion chamber has a floor portion with an opening. An upwardly extending conduit is substantially air tightly sealed to the edge of the opening. A burner is located inside the combustion chamber and a flame trap is positioned across the conduit, the flame trap permitting ingress of air and extraneous gases, if present, into the combustion chamber and prevent egress of flames from the structure. A flame arrestor is positioned at the opening and is actuated when the temperature in the combustion chamber adjacent the flame trap exceeds a predetermined temperature.

In other embodiments, the water heater includes specially constructed flame traps.

One is a ceramic material having a thickness of about 12 mm or more and having openings of about 36.6–73 openings/cm$^2$ and wherein the openings are about 64–80% of the surface of the flame trap. Another has two layers of woven mesh arranged to be in contact with each other over substantially all of their respective contacting surfaces and is formed in a non-planar orientation to facilitate substantially even layer contact during expansion and contraction.

BRIEF DESCRIPTION OF THE DRAWINGS

Selected embodiments of the invention will now be described, by way of example only, by reference to the accompanying drawings in which.

DETAILED DESCRIPTION OF THE DRAWINGS

Figure 1:
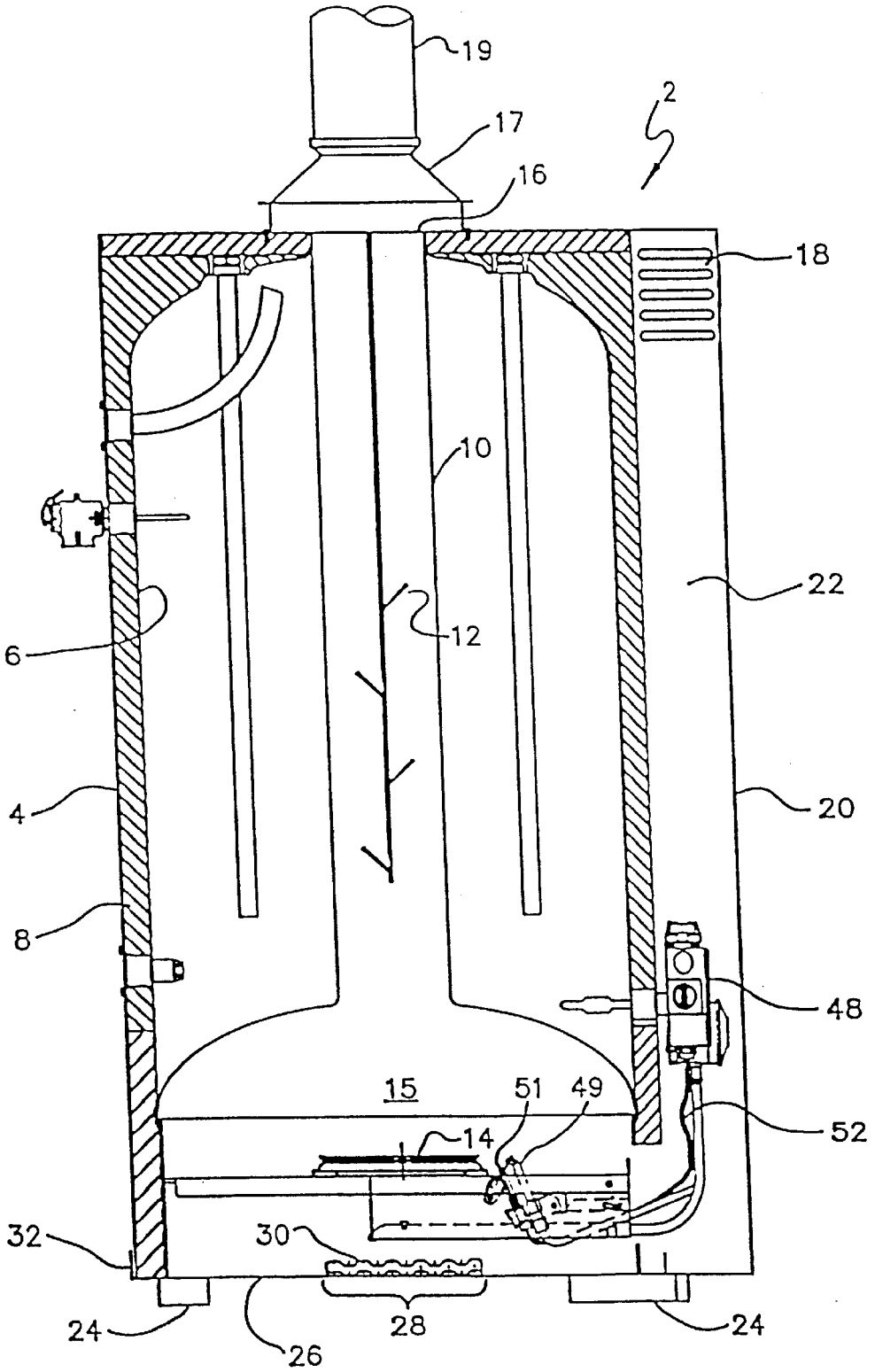
FIG. 1 is a schematic partial cross-sectional view of a gas water heater embodying aspects of the invention.

It will be appreciated that the following description is intended to refer to the specific embodiments of the invention selected for illustration in the drawings and is not intended to define or limit the invention other than in the appended claims.

FIG. 1 illustrates a storage type gas water heater 2 including jacket 4 which surrounds a water tank 6, a main burner 14 in a combustion chamber 15. Water tank 6 is preferably of mains pressure capability and capable of holding heated water. Water tank 6 is preferably insulated by foam insulation 8. Alternative insulation may include fiberglass or other types of fibrous insulation and the like.

Located underneath water tank 6 is main burner 14 which preferably uses natural gas or other gases such as LPG, for example. Main burner 14 combusts a gas and air mixture and the hot products of combustion resulting rise up through flue 10. Flue 10, in this instance, contains a series of baffles 12 to better transfer heat generated by main burner 14. Near pilot burner 49 is a sheath 52, preferably made of copper, containing wires from a flame detecting thermocouple 51 which is a known safety measure to ensure that in the absence of a flame at pilot burner 49 the gas control valve 48 shuts off the gas supply.

The products of combustion pass upwardly and out the top of jacket 4 via flue outlet 16 after heat has been transferred from the products of combustion. Flue outlet 16 discharges conventionally into a draught diverter 17 which in turn connects to an exhaust duct 19 leading outdoors.

Close to the height of the top of jacket 4 and flue outlet 16 is an air inlet 18 through which air is drawn down duct 22 to main burner 14. Duct 22 is preferably constructed from sheet metal 20. In a non-illustrated alternative construction, a part or all of duct 22 may be inside the external cylindrical envelope of jacket 4.

Water heater 2 is preferably mounted on legs 24 to raise the base 26 off the floor. In base 26 is an aperture 28 which is closed, but not gas tightly, by a flame trap device 30 which operates on a flame quenching principle. Flame trap 30 is preferably made from two parallel sheets of mesh each about 0.010 inch diameter metal wire strands woven into mesh having about 30 to 40 strands per inch. Mild steel or stainless steel wire are suitable. Alternatively, a ported ceramic tile of the SCHWANK type (registered trade mark) can be utilized although the recognized flame quenching ability of metallic woven or knitted mesh together with its robustness and ease of forming generally commends its use. The tile type functions as a flame quenching trap as long as the porosity is suitable.

A single layer of mesh or a porous ceramic tile may be susceptible to clogging by lint or other "blocking" materials such as dust or the like. Lint caught in the openings of a single mesh or a tile might act as a wick which may allow flame, which would not otherwise pass through the flame trap, to do so. In this situation the flame trap device would tend not to function as efficiently. To prevent this tendency, the flame trap is preferably constructed with either two layers of mesh or a layer of mesh and a tile. The mesh layers are most preferably in contact with one another. In this way the layer of mesh further from the source of fumes acts as a flame trap and the layer closer to the source of fumes acts as a lint trap.

Where base 26 meets jacket 4, mating surfaces 32 (made up from surfaces of base 26 and jacket 4) can be sealed thoroughly to prevent ingress of air or flammable gas or vapor. In FIG. 1, mating surfaces 32 extend upwardly from base 26 around jacket 4. The cylindrical wall of jacket 4 (the majority of gas water heaters are cylindrical; however, a cubic or other shaped jacket 4 may be utilized) can be sealed gas tightly so no openings or breaks remain upon assembly and installation. In particular, gas, water, electrical, control or other connections, fittings or plumbing, wherever they pass through jacket 4 or base 26, can be sealed airtight. The joining area (or mating surfaces 32) of base 26 to jacket 4 and all service entries or exits to jacket 4 or duct 22 need not be sealed airtight providing they are designed and constructed to have only minor surface to surface clearances or gaps, each of which is capable of acting as flame quenching traps. The structure of such service entries or exits are known in the art and not described herein. It is preferred, however, that the space around the burner be substantially air/gas tight except for means to supply combustion air.

Pilot flame establishment can be achieved by a piezoelectric igniter. A pilot flame observation window can be provided which is sealed. Alternatively, if the pilot 49 is to be lit by removing or opening an access, safety interlocks (not illustrated) are included to ensure complete closure against unprotected fume access during water heater operation.

During normal operation, water heater 2 operates in the same fashion as conventional water heaters except that most air for combustion enters at air inlet 18 and a small proportion through flame trap 30. However, if spilt fuel is in the vicinity of water heater 2 then some gas or vapor from the spilt fuel may be drawn through flame trap 30 before it builds up to a level to enter via air inlet 18. Flame trap 30 allows the combustible gas or vapor and air to enter but prevents flame escaping jacket 4 or duct 22. The spilt fuel is burned within combustion chamber 15 and exhausted either through flue 10 via outlet 16 and duct 19 or through duct 22 and inlet 18 (which in this case will act as an outlet). Because flame does not pass outwardly through flame trap 30, spilt fuel external to water heater 2 will not be ignited.

Figure 2:
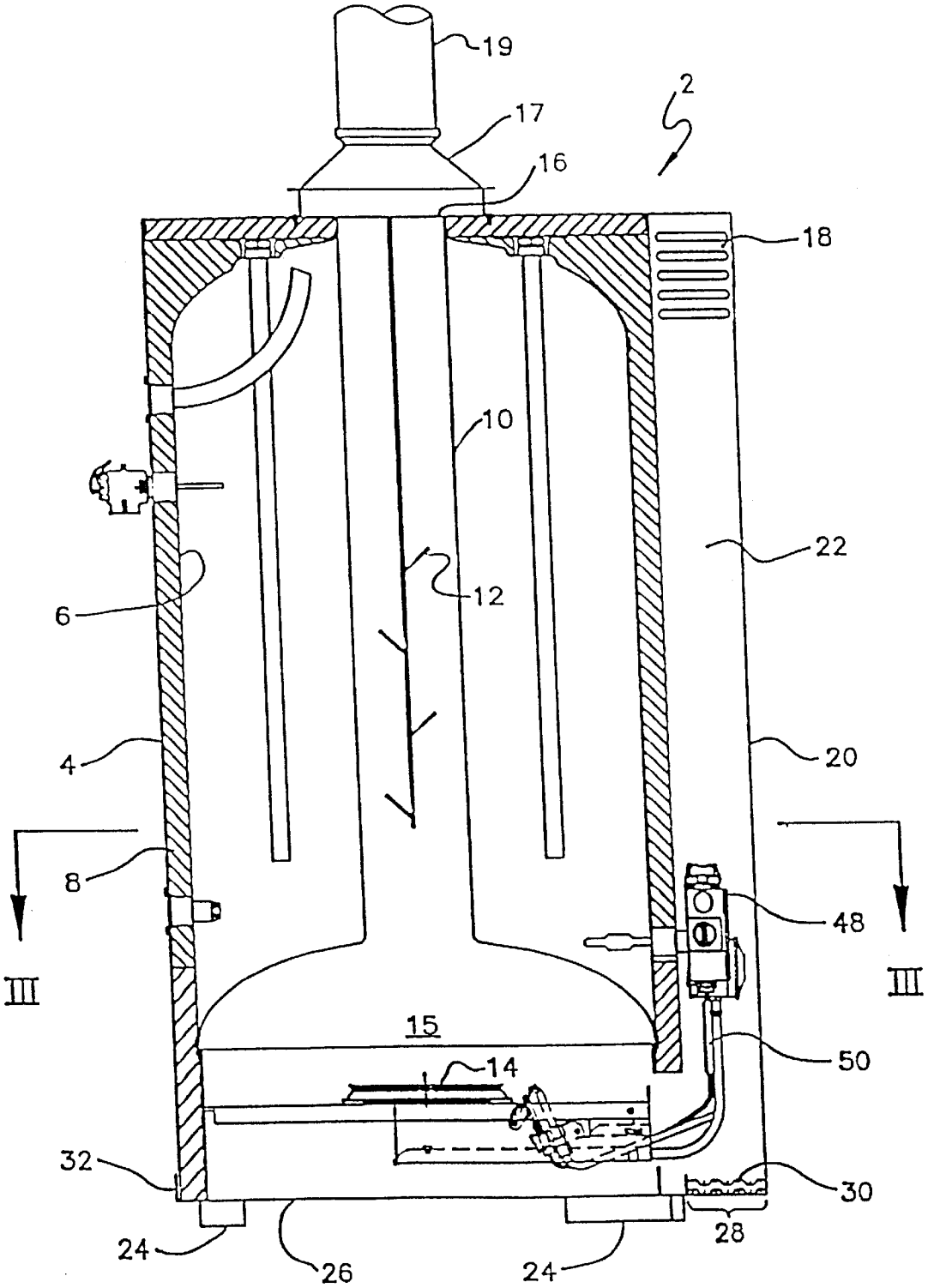
FIG. 2 is a schematic partial cross-sectional view of a gas water heater similar to FIG. 1, with additional safety features.
Figure 3:
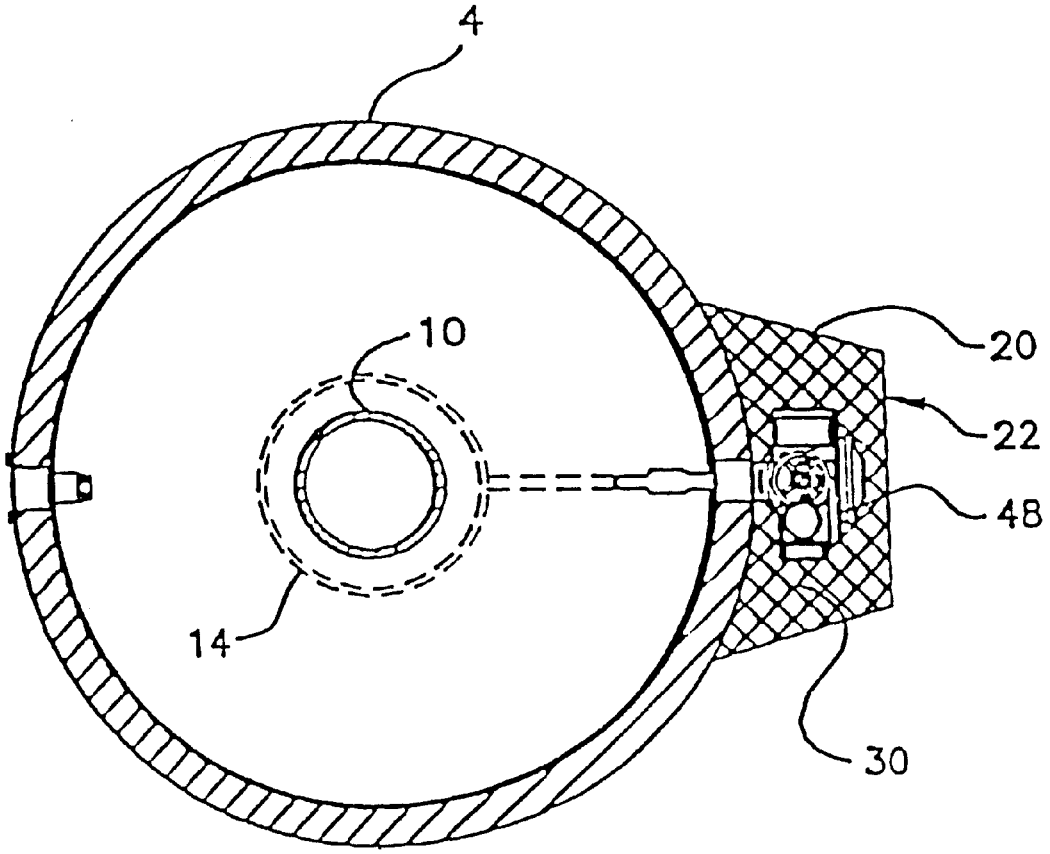
FIG. 3 is a cross-sectional view of the water heater of FIG. 2 taken through the line III—Ill.

FIGS. 2 and 3 show an embodiment similar to that of FIG. 1. Like parts use the same reference numbers as those of FIG. 1. In FIG. 2, there is adjacent gas control valve 48, a flame sensitive switch 50 which may be inserted in the same circuit as pilot flame detecting thermocouple 51.

Flame sensitive switch 50 may be substituted by a light detector or a heat detector. The flame sensitive switch can also be substituted by a gas, fume or vapor detection switch which closes off gas control valve 48 when a flammable fume is detected.

With reference to the cross section depicted in FIG. 3, duct 22 contains gas control valve 48 and flame trap 30 is shown forming a bottom end of the duct. In fact, flame trap 30 may be positioned spanning the bottom end of duct 22 and an adjacent portion of base 26. An advantage from such a positioning of flame trap 30, including that shown in FIGS. 2 and 3, by comparison with the center position of base 26 shown in FIG. 1, is that it permits positioning of flame sensitive switch 50 (FIG. 2) directly below gas control valve 48 which is also an ideal position to detect flame spillage from combustion chamber 15 which can occur if, for example, flue 16, or exhaust duct becomes blocked. Similarly, it is ideally positioned to detect flame spillage such as would occur due to air starvation if inlet 18 were inadvertently blocked.

As shown in FIGS. 2 and 3, opening 28 and flame trap 30 (including a lint trap device as mentioned above) are at the base of duct 22 below gas control valve 48 and flame detecting thermocouple 50 (see FIG. 2). In this way, should fumes which enter through flame trap 30 be ignited, a flame forms and burns on the inside surface of the flame trap and flame detecting switch 50 actuates the gas control valve 48 to shut off the gas supply, thus removing it as a continuing source of ignition. After the pilot and main flames have been extinguished, any vapors of spilt fuel continuing to enter through flame trap 30 may continue to burn because of the initial ignition and resulting suction of air and may continue to bum until there is insufficient flammable vapor remaining to be drawn in from the vicinity of water heater 2.

By providing an air inlet 18 at a high position above the base 26, the more commonplace liquid fuels, the flammable gases and vapors are far less likely to be available to a gas water heater flame.

Figure 4:
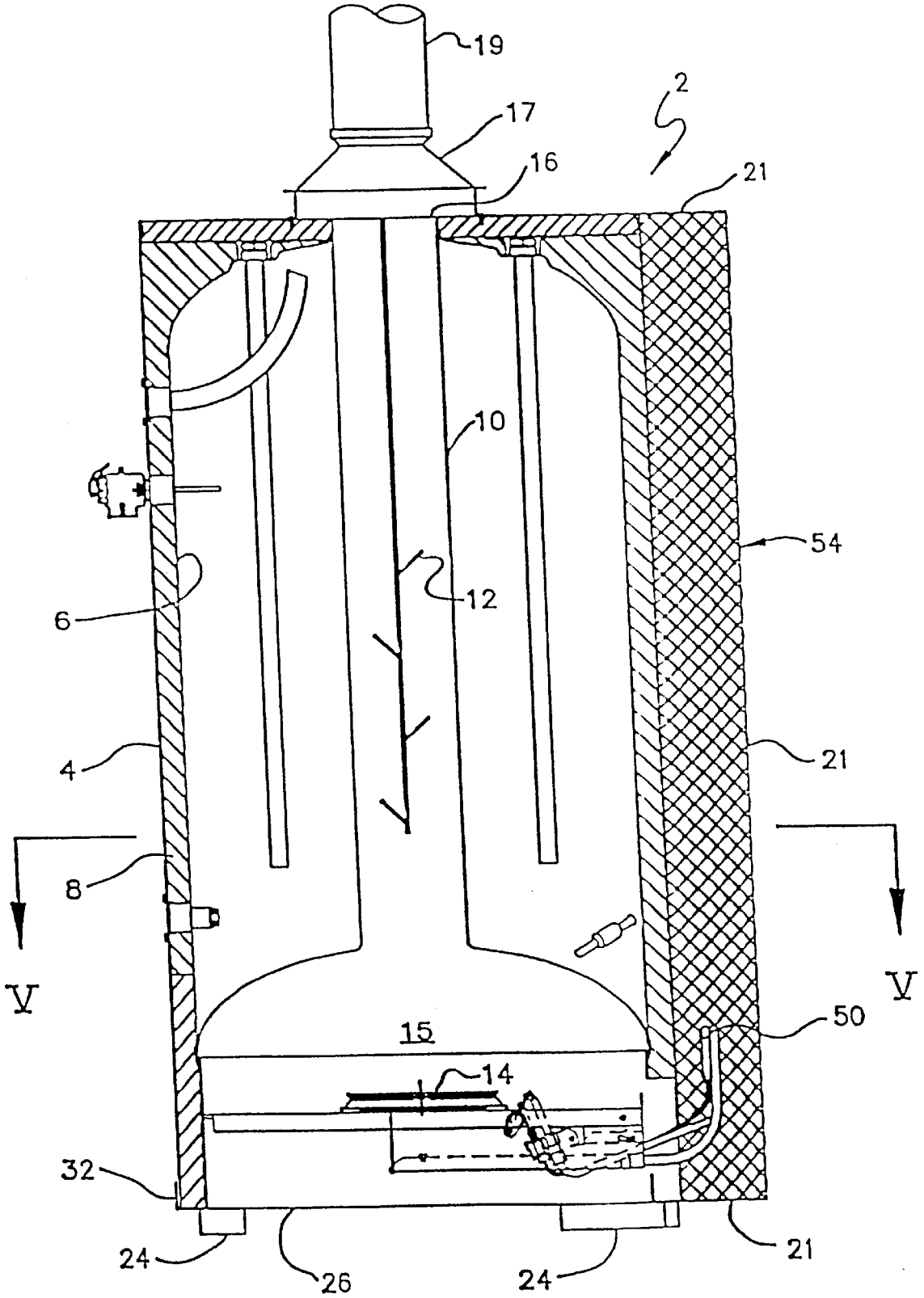
FIG. 4 is a schematic partial cross-sectional view of a gas water heater similar to that of FIG. 2.
Figure 5:
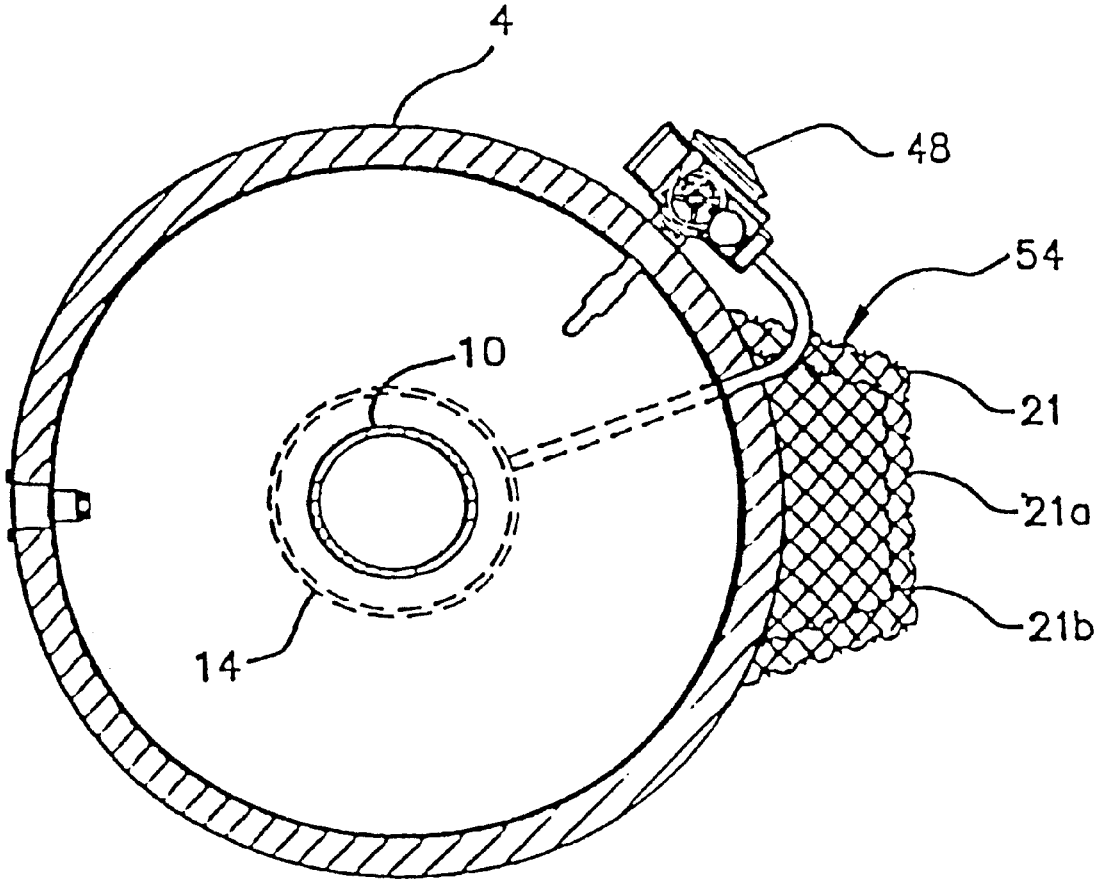
FIG. 5 is a cross-sectional view of the water heater of FIG. 4 taken through line V—V.

In the water heater 2 of FIGS. 4 and 5, the path for air entry to main burner 14 is provided by a combined flame trap and duct 54 fabricated of metallic mesh 21. This arrangement provides that combustion air passes through a flame quenching surface 21 and the height of duct 54 need not be as high as jacket 4 nor need it necessarily extend upwardly. As evident in FIG. 5, it is preferably composed of separated layers 21a and 21*b* of metallic mesh. This two layer construction avoids a layer of lint, deposited externally, providing a possible combustion path through the mesh, as previously explained.

Lint deposition in the openings of the mesh may be a cause of gradual blockage. In due course such Tinting may cause starvation of combustion air. Therefore, an extended surface area (along the full height of water heater 2 as depicted for instance) of the combined flame trap and air duct 54 may be of advantage for prolonging the time taken for duct 54 to become occluded with lint and for providing an adequate path for free induction of the air normally required for combustion.

The positioning of gas valve 48 in its preferred position is shown in FIG. 5 outside of duct 54. The entry of the gas pipe and thermocouple sheath into duct 54 is effected so that if a hole is left it is small enough either to be totally sealed or to act as a flame quenching trap.

The preference for gas valve 48 outside duct 54 is that it provides one way of providing user access to the control knob and any buttons on gas control valve 48. It would be equally applicable in cases where duct 22 is made of imperforate sheet metal 20 as shown in FIGS. 1 and 2.

For ease of construction one option is that the gas pipe and thermocouple sheath can enter water heater 2 via an opening in jacket 4, completely bypassing duct 54. This opening can then be sealed or if a gap is left, the gap is sized to act as a flame trap. However, whichever way the thermocouple sheath passes to enter the combustion chamber, if it includes flame sensitive switch 50 or other equivalent sensor, then it is greatly preferred that the flame sensitive switch 50 or other sensor is located in relation to the position of flame trap 30 so that the relative positions co-operate in the event that a flame from spilt fuel forms on the flame trap.

Figure 6:
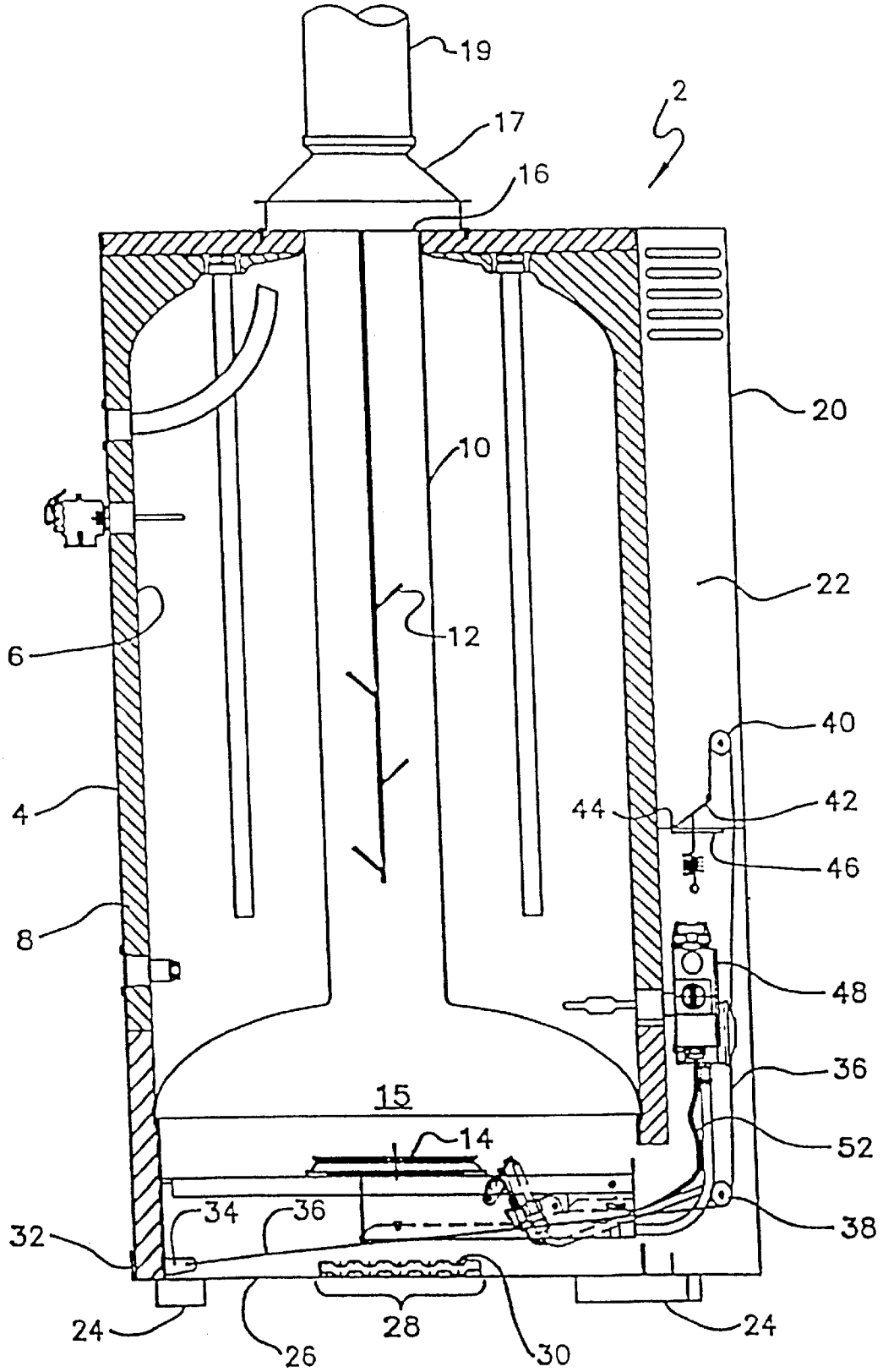
FIG. 6 is a schematic partial cross-sectional view of a gas water heater with a safety feature in accordance with aspects of the invention.

Illustrated in FIG. 6 is a another embodiment of the present invention, similar to that of FIG. 1, with like parts like numbered. This embodiment includes an anchor 34 which anchors a nylon line 36 which is a heat sensitive frangible member. The nylon line 36 passes close to the upper surface of flame trap 30 and around a lower pulley 38 then continues on to an upper pulley 40 around which it passes through 180 degrees, to make connection with a flap 42. Flap 42 is connected by hinge 44 either to the inside of passage 22 or to a flange 46.

Flange 46, if it is utilized, can have a sealing medium(not illustrated) around it so that when flap 42 makes contact with it, an air tight seal or a flame trap is formed. If flange 46 is not utilized, flap 42 can carry a seal so that, when released to move to a closed position, it will seal the inside of duct 22 to air tight quality or, in the alternative to form a flame trap. Flap 42 can be biased towards the closed position by a spring, which is a preferred method, or alternatively the biasing can be by means of gravity. If desired, flap 42 can be constructed from mesh, as described above to act as a flame trap.

Figure 7:
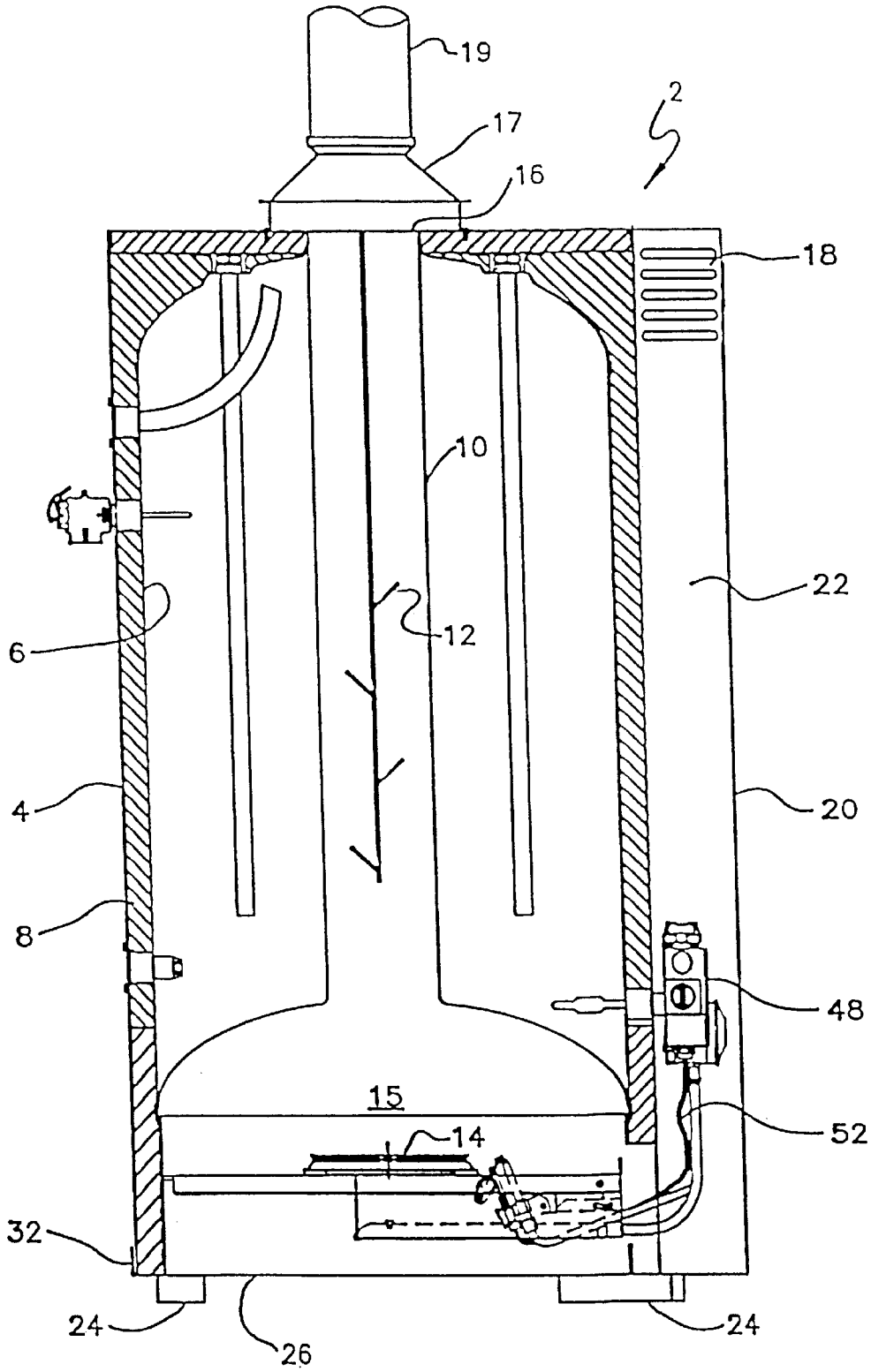
FIG. 7 is a schematic partial cross-sectional view of a gas water heater of another embodiment of the invention.
Figure 8:
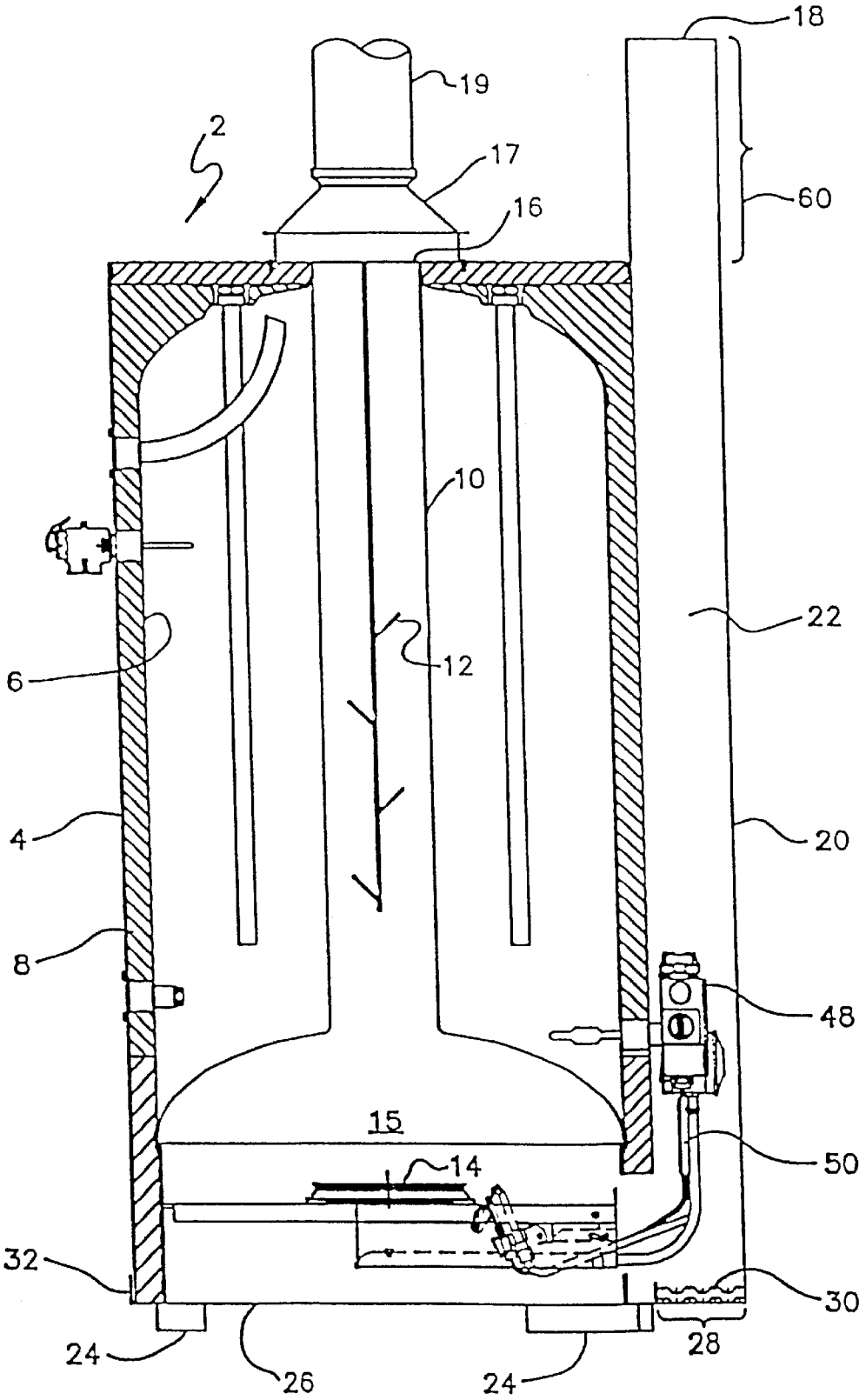
FIG. 8 is a schematic partial cross-sectional view of a gas water heater of yet another embodiment of the invention.

In the embodiment of FIG. 6, when fumes from spilt fuel passing through the flame trap 30 are ignited, the heat of ignition breaks nylon line 36, which is heat sensitive and frangible, thereby causing flap 42 to move to a closed position, shutting off the air supply to main burner 14. This leaves no path down duct 22 for air or combustible fumes which may have built up around water heater 2 to sufficiently gain access to main burner 14 and so pilot burner 49 and main burner 14 may not have enough air available through flame trap 30 to continue burning in which case flame detection thermocouple 50 will cut off the gas supply until manual intervention can restore it when a safe atmosphere is restored. In FIGS. 7 and 8 are illustrated a gas water heater 2 constructed similarly to that illustrated in FIG. 1. Water heater 2 includes a base 26 and jacket 4 which are either completely sealed (not illustrated) to air tight and flammable gas or vapor tight quality or, alternatively, unsealed gas paths are fine (small) enough to act as flame traps. In this instance, when completely sealed, air for combustion is drawn in from the air inlet 18, and there is no means present to ignite spilt fuel at the lower portions of water heater 2.

The embodiments shown in FIGS. 7 and 8 have no flame trap 30 or opening 28. However, an appreciable time delay will occur before gases or vapors from spilt fuel rise to the elevated level of air inlet 18. Only then could the gases or vapors be drawn down passage 22 to main burner 14. Many spillages, nevertheless are quite minor in terms of volume of liquid spilt and in such cases the embodiment of FIG. 7 would tend to provide an adequate level of protection and that of FIG. 8 even more so. The air inlet 18, if it does not include a flame trap 30, should be at least about 500 millimeters (20 inches) from base 26 (if base 26 is near to the ground), in the presence of gasoline fumes (a different height may be required for other fumes). However, for added protection a greater distance is preferred.

The more frequently used typical flammable fumes of spilt liquid fuels are far less likely to be available to a gas water heater flame by providing an air inlet 18 at a high position above base 26.

If base 26 and jacket 4 has small gaps or openings limited in their size to act as flame traps, then its operation will be similar to the embodiment of FIG. 1. The features of FIG. 6 can be incorporated also with the embodiments described in FIGS. 7 and 8 when base 26 and jacket 4 are sealed. In this instance, because the water heater now includes a heat sensitive frangible member 36 located in an air passage in the vicinity of the main burner 14, if gases or vapors ignite having flowed down the passage 22 (which would indicate that the volume of gases or fumes had risen to the level of air entry of the air inlet 18), the resulting flame would melt a frangible member such as nylon line 36 in the vicinity of main burner 14. Nylon line 36 can be connected in turn to a non-flammable and non-frangible section which in turn makes connection with a spring biased flap similar to flap 42 capable of sealing passage 22. The distance between nylon line 36 and flap 42 is sufficiently long to close passage 22 before a flame travelling back up passage 22 reaches flap 42. If flap 42 is hinged so that its closing motion is in the direction that flame would have to travel to exit passage 22, the hinging arrangement may be aided in closing by the movement of flame in a closing direction.

A further improvement to the above embodiments shown in FIGS. 1–6 is to provide a snorkel 60 as shown in FIG. 8 extending the air inlet upwardly. Snorkel 60 allows air to be drawn to main burner 14 but, by taking air from a height above the top of jacket 4, will further reduce the risk of water heater 2 being an ignition source of flammable gases or vapors from spilt fuel. If the height of jacket 4 is not greater than about 500 millimeters (20 inches) above base 26, snorkel 60 can be used to draw combustion air from a more appropriate height, depending upon the spillage which may occur.

In conjunction with any form of the invention as shown in FIGS. 1 to 6, a gas shut down facility similar to the above mentioned gas shut down ability can be provided. In another form, the gas shut down facility can be initiated by a flame sensitive switch 50 or thermocouple 51. Such a thermocouple is preferably located just inside of the flame trap 30 where ever it appears. Flame sensitive switches may also be used in circuit with the thermocouple (e.g., thermocouple 51 of FIG. 1) provided for confirming the establishment and retention of a pilot flame by raising an electric current flow to a level capable of keeping open a gas supply to the pilot burner.

Flame sensitive switches may be used to reduce fire hazards in circumstances where flame of the burner can "spill" through an air access opening adjacent the main and pilot burners. In known flame sensitive switches, the heat sensor is externally positioned and in some embodiments of the invention a flame sensitive switch 50 is positioned above flame trap 30 to sense flame heat input resulting from spilt flammable vapor burning on the inside of flame trap 30 after having entered the combustion chamber through a possible entry path. In the embodiment of FIG. 1, the preferred position of the flame sensitive switch (not illustrated) is immediately above the flame trap and it is preferred that a small heat shield (not shown) be placed above the flame sensitive switch to shield it from the normal radiant heat associated with the main burner 14. In FIG. 2, the flame sensitive switch 50 is positioned a short way above flame trap 30.

An additional level of safety is provided by the addition of an oxygen depletion sensor in conjunction with pilot burner 49. This makes available the entire air requirement for the pilot flame to the pilot burner only through a pilot air duct (not illustrated), gas tightly separate from air supply duct 22 and combustion chamber 15. The pilot air duct has an air intake external to the remainder of the water heater assembly, preferably low to floor level where water heaters are generally installed, standing upright on a floor. At any convenient location in the pilot air duct between the air intake end and the pilot burner is a flame quenching insert, composed of one or more of a variety of high thermal capacity gas porous heat resistant materials such as described in relation to flame trap 30. Locating the flame quenching insert at or near the air intake end is advantageous to make it accessible for cleaning of lint or dust that may accumulate in it. An element sensitive to oxygen depletion is also located in the pilot air duct.

With these features added to the embodiments of FIGS. 1 to 7, use of the oxygen depletion sensor reduces the risk of ignition of flammable vapor in particular when pilot burner 49 is alight but main burner 14 is not, by sensing oxygen depletion in the incoming pilot air supply if a flammable component ignites in which case it would cause a gas control valve 48 of the type referred to in FIG. 1 to shut down gas flow to the pilot burner. The shut down provides a time period for flammable vapor to safely ventilate. Resumption of normal operation of the water heater requires human intervention but, even if done ill-advisedly, in any event the oxygen depletion sensor would continue to deny pilot burner 49 of gas and the arrangement would behave safely even with extraneous flammable fumes remaining near water heater 2. An oxygen depletion sensor can be used alternatively in place of or in conjunction with the previously described flame sensitive switch 50, and can be located similarly.

The invention thus far described can function at three levels of safety. The embodiment, as illustrated in relation to FIGS. 7 and 8, adds height and distance that fumes from spilt fuel must travel to reach main burner 14 or pilot burner 49. The second embodiment, as illustrated in FIGS. 1, 2, 3 and 6, adds not only height and distance but also allows some and advantageously all the extraneous fumes to enter the base of water heater 2 and be consumed safely, conceivably until all residual risk of fire and explosion is avoided by dissipation of the spillage.

The third level, as illustrated in FIGS. 4 and 5, adds a further level of confidence by protecting all air entry with a flame arrestor, recognizing that high levels of airborne lint or other dust may tend to block the air intake and starve the burner of air for combustion if the air entry were not periodically cleared of that lint or other dust. The embodiment of FIGS. 4 and 5 can be constructed to protect against ignition of flammable gases and vapors outside of the enclosure or jacket regardless of the density of those gases and vapors relative to air.

In its most preferred forms water heater 2 contains at least some of the following features:

- the opening includes an aperture which is covered by a flame trap, which prevents the burner from igniting extraneous fumes outside of the enclosure, and an air inlet through which air for combustion purposes is drawn;
- the opening is remote from the burner and includes a duct for passage of air to the burner;
- the opening and the aperture are collocated or are a single item;
- the at least one opening is covered by a flame trap;
- the aperture is in the enclosure;
- the aperture is positioned close to a lower end of the enclosure;
- the aperture is positioned in a lower end of the enclosure;
- the aperture is positioned below the burner;
- the aperture is positioned to allow air and fumes outside of the water heater to enter into an air passage leading to the burner;
- the aperture allows air and fumes to enter the lowest point of the air passage;
- one of or a combination of: a light detection or sensitive device; a flame detecting or sensitive device; a temperature sensitive or detecting device; a heat detecting or sensitive device; and an oxygen depletion sensitive or detection device, is located in the water heater to detect flame from the fumes if they have been ignited inside the enclosure;
- the opening includes an air inlet which is not covered by a flame trap, the air inlet having its lowest opening at a height of not less than about 500 millimeters or about 20 inches or more from the bottom of the enclosure;
- the opening is located at or adjacent to the highest point of the enclosure, if the enclosure has a height of about 500 millimeters or greater, from the bottom of the enclosure;
- a snorkel device is provided to extend the at least one opening to a height above the highest point of the enclosure;
- the flame trap includes a heat resistant permeable material having high thermal capacity;
- the flame trap includes a screen selected from either woven or knitted mesh;
- the flame trap is made of metal;
- the flame trap is made from a metal selected from the group consisting of: steel, stainless steel, copper and aluminum;
- a lint trap is included to wholly cover the aperture and the flame trap;
- the lint trap is formed by mesh placed in the path of lint or dust travelling to the flame trap means;
- the water heater includes a gas shut off means which shuts off the gas supply to the burner and or a pilot burner if the air and fumes are ignited after entering the enclosure;
- the gas shut off means includes a heat sensitive means;
- the gas shut off means includes a flame sensitive switch;
- the gas shut off means includes an oxygen depletion sensitive means;
- the enclosure comprises a separable jacket and base;
- the flame trap is provided at or as part of the construction of joining areas of the base to the jacket, or the jacket to other component or the base to other component or at any location where the fumes could enter the enclosure;
- the flame trap is inherent in or is formed by the joining areas including either only gaps or apertures of a size small enough to act as a flame trap;
- the flame trap has been added to the joining area or is deliberately incorporated as part of the joining area;
- the flame trap is a layer of metallic mesh cooperating with the joining area to achieve the flame quenching or arresting function;
- the flame trap is inside of the water heater; and
- the gas shut off means includes a light detection means.

One advantage provided by the invention is the provision of a barrier to unprotected entry, at the lower end of the jacket or enclosure, of flammable extraneous fumes. In alternative embodiments it provides a protected entry means for such fumes near or at the base of the enclosure in which case these extraneous fumes are consumed in a controlled manner. The protected entry is, in the most preferred form, a flame trap preventing ignition of the remaining fumes in the surrounding atmosphere or of any liquid remaining nearby.

An advantage of locating the air intake for combustion purposes above the midpoint of the gas water system is that it reduces the chance of extraneous fumes entering the heater via the air intake because generally such flammables are heavier than air, which in the main do not attain dangerous levels at the air intake level.

The use of air close-off means and gas shut-off means activated by a trigger provides the advantage of suffocating any flame in the heater, or switching off the gas supply, or preventing uncontrolled or undirected ignition of gases or vapors from exiting the heater environment.

By providing an extended air intake, the risk of lint or dust affecting the efficiency of the water heater is reduced.

Figure 9:
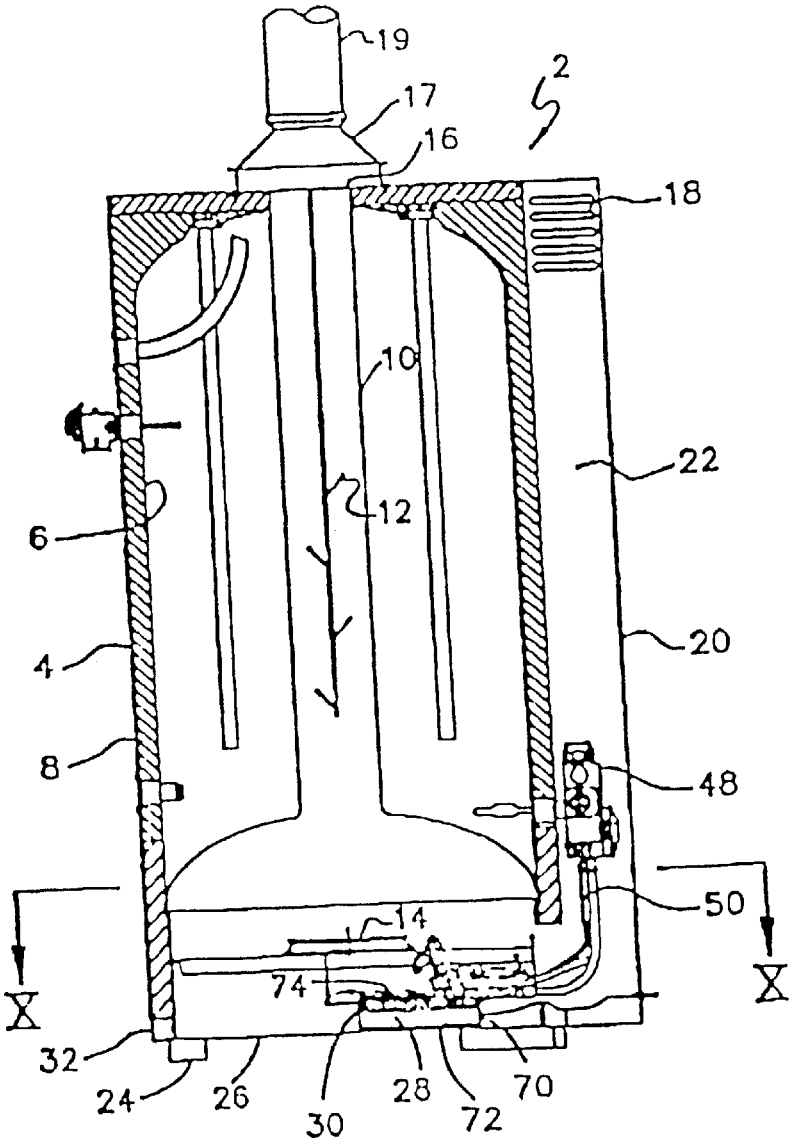
FIG. 9 is a schematic partial cross-sectional view of still another embodiment of the invention.
Figure 10:
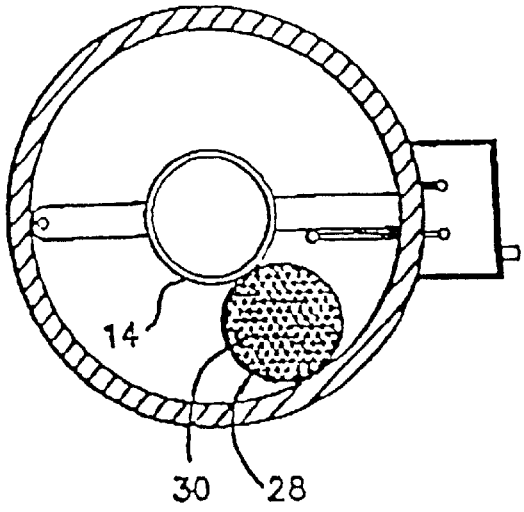
FIG. 10 is a cross-sectional view of the water heater of FIG. 9 taken through the line X—X.

Still further advantages of the invention are provided by the structure shown in FIGS. 9 and 10. FIGS. 9 and 10 show water heater 2 wherein aperture 28 having flame trap 30 across its mouth and positioned below pilot burner 49, pilot burner 49 being located adjacent one edge of main burner 14. Aperture 28 is positioned immediately underneath pilot burner 49, preferably the closer the better to assist in achieving smooth ignition. Aperture 28 is connected to the lower end of the enclosure by an upwardly extending tube 70, the upwardly extending portion of tube 70 being preferably impermeable to air, gas or fumes. Tube 70 is preferably constructed of sheet metal, although other suitable materials may be substituted. Locating flame trap 30 above base 26 minimizes the possibility of water condensate occluding the pores or openings in flame trap 30 or water splashing from, for example, hosing the floor near base 26 of water heater 2. Thus, the length of tube 70 is not especially critical so long as it performs the function of preventing pore occlusion. In FIG. 9, a horizontal blocking plate 74 is located above flame trap 28 to prevent water condensate or particulate matter such as steel scale flakes falling on the flame trap, thereby reducing the chance of occluding it.

It has also been discovered that a two layer construction of flame trap 30 with a lint filter is highly advantageous. FIG. 9 illustrates a lint filter 72 in addition to a double layer flame trap 30. Filter 72 may be a different material from flame trap 30. The potential for accumulation of lint over time has been a concern. However, it has been unexpectedly discovered that structure such as that shown in FIGS. 9 and 10 is surprisingly free of lint accumulation problems. It is believed that the horizontal and very close positioning of flame trap 30 to main burner 14 results in small pressure pulses associated with main burner 14 igniting on each occasion. Apparently, the pulses blow away any lint from the face of flame trap 30. This appears to provide a repeating self-cleaning effect.

Another significant advantage of the water heater of the invention is its improved gas control valve. In conventional gas valves, the thermocouple and over-temperature fuse have been inconveniently located in an integrated structure sheathed in a copper capillary tube with significant thermal inertia. If either the thermocouple or the temperature fuse require replacement then it is not immediately apparent which one has failed and, because both are replaced as an integrated unit, unnecessary cost is involved. The thermal fuse is a relatively low cost item compared to the entire integrated structure and, therefore, it is advantageous to be able to test the circuit by merely removing the suspect fuse and replacing it. This test does not involve removal of the thermocouple which requires awkward access into the water heater combustion chamber. Thus, there can be a considerable reduction in the time a water heater service person needs to identify and correct a problem in the many cases where an open circuit is related to the fuse rather than the thermocouple. Therefore, the reason for replacement being necessary can be ascertained more directly and, thus, safe operation resumed more certainly.

FIGS. 11–14 show a gas control valve 48 supplying main burner 14 having an adjacent pilot burner 49 in water heater 2 with combustion chamber 15, including a gas inlet 120 for connection to a supply (not shown) of combustible gas. Valve 48 has a gas outlet 124 for connection to a conduit (not shown) leading to main burner 14 and an outlet 126 to connect to pilot burner 49. Internal components of the valve include an orifice or conduit 127 for gas flow between the inlet 120 and outlet 124 and a closure 154 normally resiliently biased to close the orifice to prevent or permit flow of gas from the inlet 120 to the outlet 124 as required.

Figure 15:
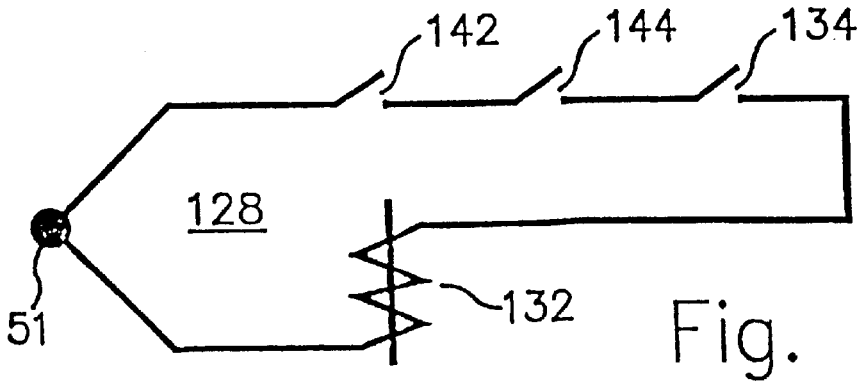
FIG. 15 is an electrical circuit embodied in the gas valve shown in FIGS. 11–13.
Figure 12:
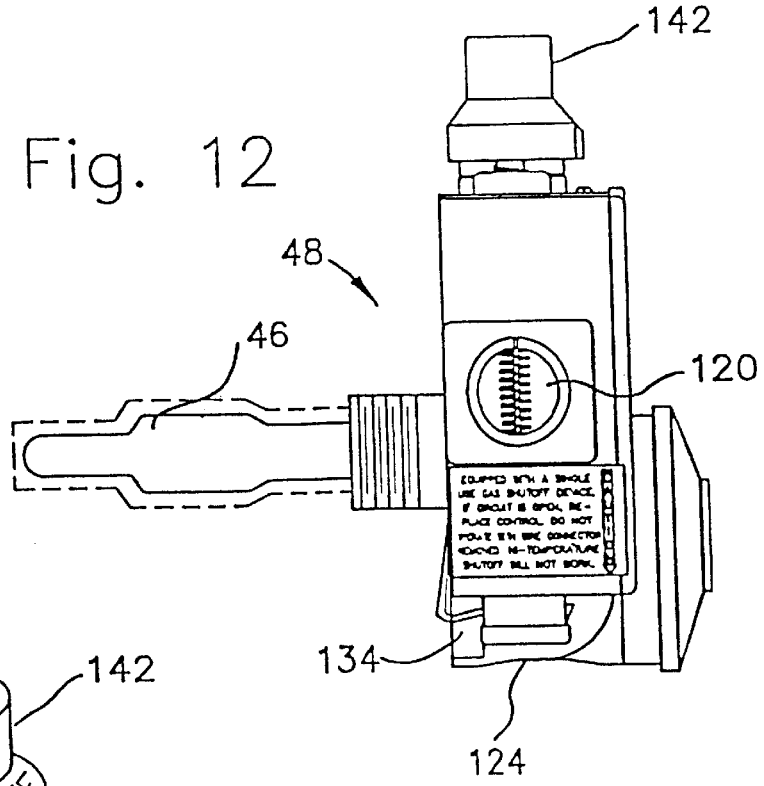
FIG. 12 is an upright elevational showing the left side of the gas valve shown in FIG. 11.
Figure 13:
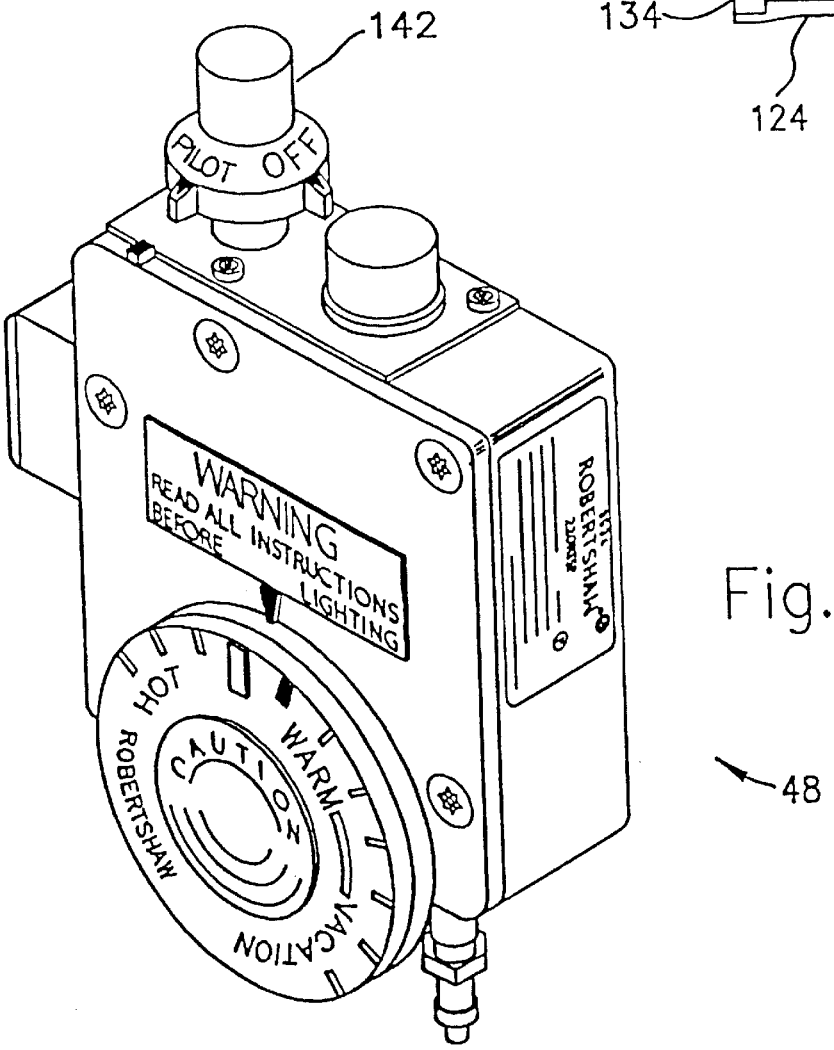
FIG. 13 is an upright perspective view of the valve of FIGS. 11 and 12.

Incorporated in valve 48 is an electrical circuit 128 such as shown in FIG. 15, including thermocouple 51 connected to a solenoid 132. Thermocouple 51 provides an electrical potential, sometimes hereinafter referred to as "signal," when heated by a flame established at pilot burner 49, typically 12 to 15 mV, to solenoid 132 which is sufficient to maintain solenoid 132 open against the normally closing bias of a spring 156 associated with closure 154. Specifically, the electrical potential is provided to solenoid 32, creating a magnetic force which, via an armature connected to closure 154, maintains closure 154 open. It should be noted that the electrical potential is not sufficient to open closure 154 from its closed position except when valve passage 127 is first opened by manual switch 142 being manually positioned in the "pilot" or "on" positions and the potential is adequate to maintain closure 154 in its open position.

When a flame is absent at pilot burner 49, valve 48 remains shut except during a start up procedure. The circuit has a manual switch 142 with three positions, "off", "pilot" and "on". In the "pilot" position the switch may be depressed to hold open valve 48 while thermocouple 51 heats sufficiently to power circuit 128. Manual switch 142 is depressed in the "pilot" and "on" positions to lift closure 154 off its seat against the closing bias force of spring 156. In the open position, an electrical current passing through the coil of solenoid 158 generated by the thermocouple 51 when heated by the flame of the pilot burner 49 (FIG. 4) is adequate to maintain closure 154 in the open position during normal use of water heater 2. Normal use of water heater 2 involves pilot burner 49 being alight at all times.

An over-temperature energy cut out 144 is installed inside a temperature sensitive thermostat probe 146 (shown in FIG. 12) which interrupts all gas flow through the valve in the event that an unsafe temperature develops inside the tank.

Figure 11:
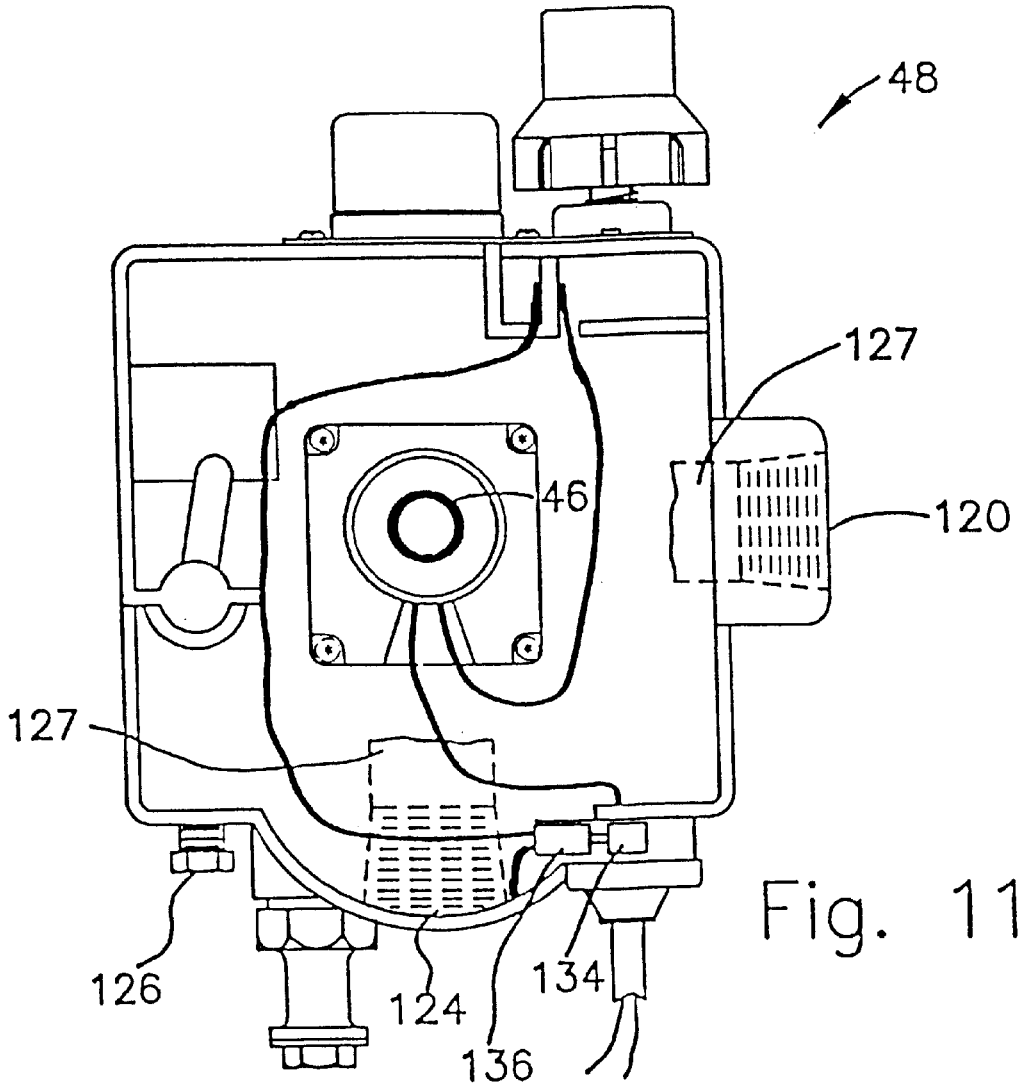
FIG. 11 is an upright elevational view taken from the rear of a gas valve according to the aspects of invention.

As best seen in FIGS. 11 and 15, valve 48 has a fuse 134 connected in electrical circuit 128 and exposed at the bottom surface of valve 48 to be sensitive to extraneous sources of flame and heat external to and in the region of the valve, particularly underneath it.

Valve 48 features an externally accessible socket 136 in electrical circuit 128 in which thermal fuse 134 is removably inserted. Socket 136 is positioned to receive thermal fuse 134 independently and separate from thermocouple 51.

Figure 14:
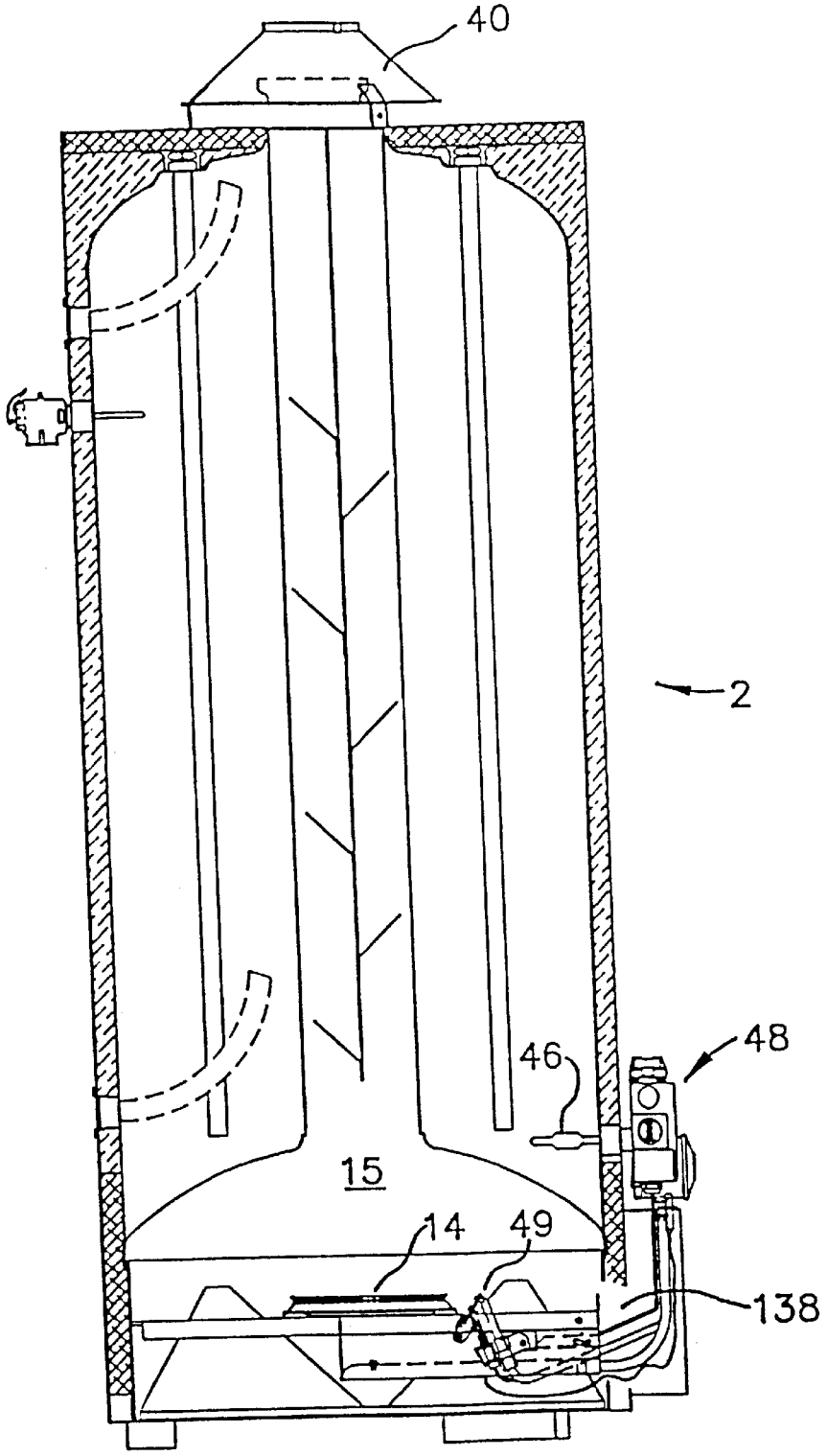
FIG. 14 is a schematic partial cross-sectional view of a water heater with the gas valve as shown in FIGS. 11–13.

Socket 136 and fuse 134 are accessible from the underside of valve 48 as shown in FIGS. 11 and 14 wherein valve 48 is mounted on an external vertical wall of water heater 2. This leads to the advantage of rapid response time since the underside is most likely to be impinged upon by extraneous flame because valve 48 is also vertically above access point 138 to main burner 14 and pilot burner 49 such as for lighting, inspection and combustion air entry. Extraneous flame and heat within water heater 2 may result from accidental combustion of a flammable substance near water heater 2, the flame being likely to establish itself firstly adjacent to access point 138.

Another advantage of mounting fuse 134 to be accessible at a downward facing surface of valve 48 is that fuse 134 would not be as noticeable upon a casual inspection of water heater 2 and valve 48 and, therefore, not so likely to invite removal by personnel unaware of its safety-motivated purpose. Water heater 2 will not continue to function if it were removed and not replaced.

Despite the preferred downward facing position of fuse 134, positions on other faces of valve 48 are possible. Fuse 134 has minimal thermal inertia and to that end involves minimal mass and is not enclosed in a copper or similar sheath. A preferred fuse 134 is one encapsulated only in a small quantity of organic polymer resin. One presently preferred form of thermal fuse 134 is manufactured by Therm-O-Disc, Inc., Mansfield, Ohio, USA. The radial lead type is the most suitable for insertion into a socket 136 and a model available with a maximum rated opening temperature of 102° C. has a suitably rapid response time.

Figure 17:
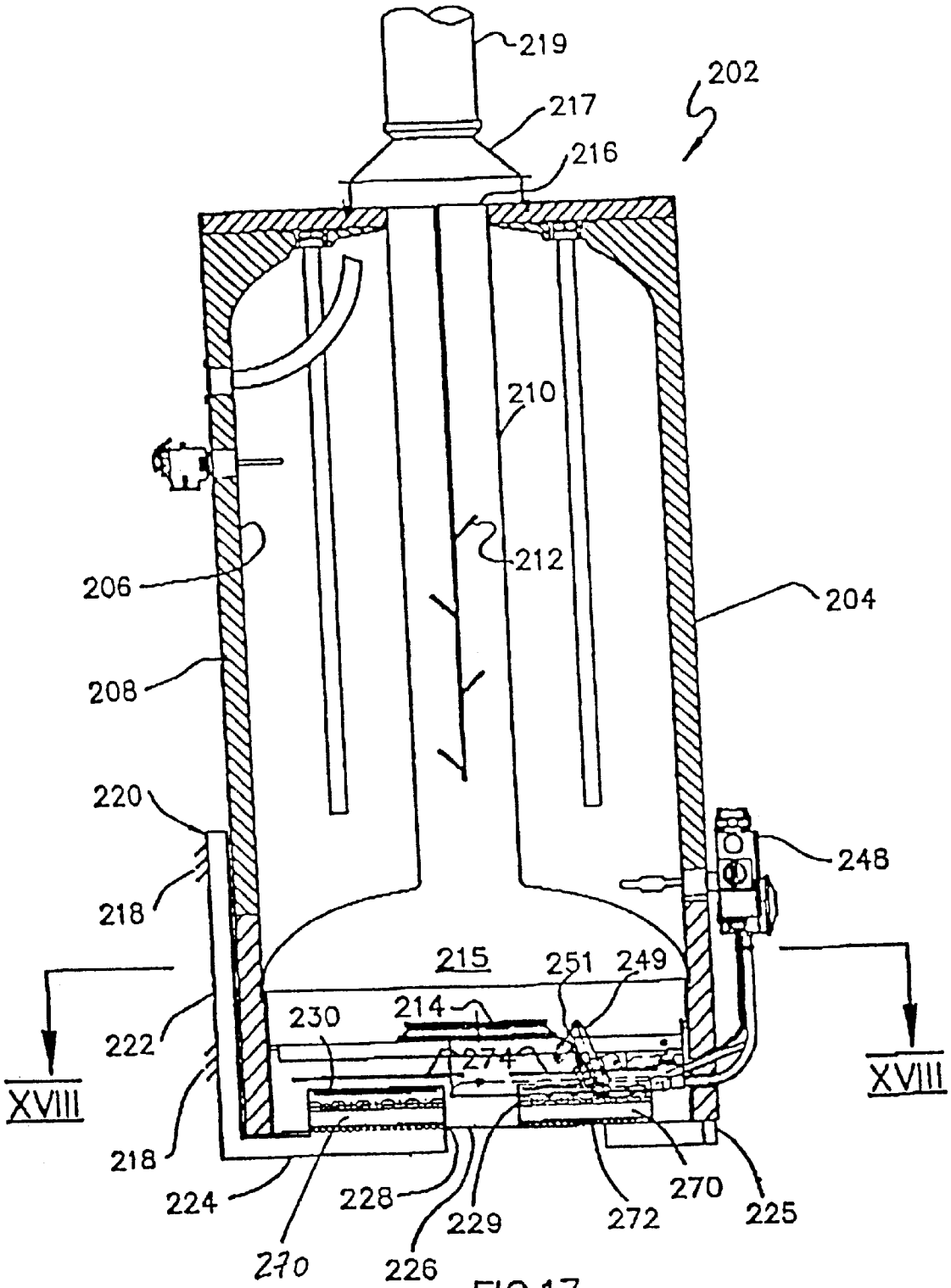
FIG. 17 is a schematic partial cross-sectional view of a gas water heater embodying further aspects of the invention.
Figure 18:
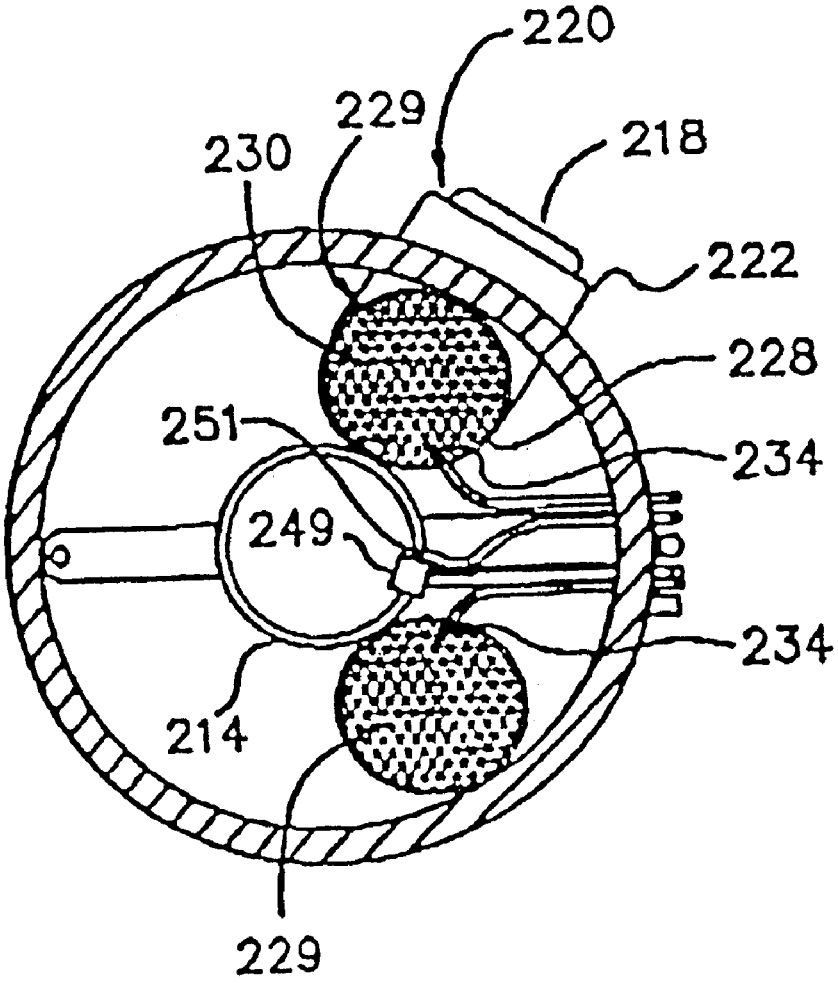
FIG. 18 is a cross-sectional view of the water heater of FIG. 17 taken through the line XVIII—XVIII.

Still further advantages of the invention are provided by the structure shown in FIGS. 17 and 18. All number labels associated with FIGS. 17 and 18 have been increased by two hundred over corresponding structure previously described in association with FIG. 1. New structure described below also carries the same two hundred characterization. An air duct sub-assembly 220 is provided having an upwardly extending first duct portion 222, a radially extending second duct portion 224 and an upwardly extending tubular portion 270. First duct portion 222 preferably extends substantially vertically and may be fixed to jacket 204. The upwardly extending tubular portion 270 is adapted to pass through an aperture 228 in the water heater base 226 at which it is sealed to flame quenching standard. The upwardly extending tubular portion 270 is covered at the upper end by a flame trap 230.

The radially extending second duct portion 224 that communicates with the interior of the first duct portion 222 and the interior of the upwardly extending tubular portion 270 is advantageously substantially horizontal and dimensioned in its vertical distance to be able to act as or part of a support structure 224, 225 to support the heater base 226 level above floor level. This structural arrangement makes it very difficult for improper removal of the duct sub-assembly with the flame trap 230 by untrained personnel. Furthermore, should removal of the flame trap 230 be necessary, trained personnel servicing the water heater will not be encouraged to return the water heater to service without replacing the flame trap since doing so would result in the water heater being not supported level and stable. This is a further advantage over conventional water heaters. Of course, it should be understood that the size and shape of duct portions 222 and 224 may be varied to accommodate various sizes and shapes of water heaters and their particular installation settings. Also, the location of duct portions 222 and 224 may be varied as desired. For example, either or both of duct portions 222 and 224 can be positioned interiorly of the water heater. As an example, duct portion 222 can extend upwardly between jacket 204 and tank 206, with air intake openings 218 extending through jacket 204. Similarly, duct portion 224 may be positioned within combustion chamber 215.

Flame trap 230 is preferably located above base 226 to minimize the possibility of water condensate accumulating in the base to a level sufficient to occlude the pores or openings in flame trap 230. This is because the flame trap is elevated far higher than the depth of condensate which could accumulate on base 226.

The upwardly extending first duct portion 222 is provided with air intake openings 218 at two or more positions up the extent of its height to facilitate uniform non-explosive consumption of flammable fumes that may, as a result of spillage, engulf the water heater. Louvres may also be provided over openings 218 to facilitate even consumption of fumes. It would normally be expected that spilt flammable fumes such as gasoline would reach the water heater very close to floor level and be induced into the combustion chamber 215 through aperture 228 and be consumed at flame traps 230 and/or 229 by non-explosive burning. However, unlikely though it may be, uncharacteristic stratification patterns of spilt flammable fumes in a room could enable entry of those fumes to water heater 202 at openings 218 before entry through aperture 229. By having openings 218 at a variety of heights, it is intended that duct 220 as a whole will tend to contain lower quantities of effective potentially explosive vapors at any one time before, as will be explained below, means to sense and react to the presence of combustion at one or both flame traps 229 and 230 can be effective.

In FIG. 17, air duct sub-assembly 220 is illustrated, for clarity, positioned 180° away from the point in the vertical wall of jacket 204 where gas control valve 248 is mounted and where the pipes connecting gas control valve 248 to pilot burner 249 and main burner 214 pass into combustion chamber 215. However, the most preferred location for air duct sub-assembly 220 is as indicated in FIG. 18. This preferred location is chosen so that the flame trap 230 is as close to both the pilot burner 249 and non-ducted flame trap 229 as possible, given that it is also desired to avoid locating gas control valve 248 (see FIG. 17) inside the upwardly extending first duct portion 222 because this denies ready access for adjusting the temperature setting knob on gas control valve 248. Construction of the air duct sub-assembly 220 as such provides advantages in manufacture because it can be joined structurally to the water heater without requiring to be sealed to flame quenching standards at any point other than the aperture 228 through the base of the water heater.

The embodiment of water heater 202 differs from those already illustrated insofar as combustion chamber 215 is enclosed at the vertical sidewall at the point where the pipes connecting gas control valve 248 to main burner 214 and pilot burner 249 enter combustion chamber 215. All air required for combustion is therefore induced by natural draft through the flame traps 229 and 230. Both flame traps 229 and 230 have horizontal blocking plates 274 (omitted for clarity in FIGS. 18, 19 and 21) spaced vertically above their respective flame trap by a clearance distance adequate to allow combustion air to freely flow through the flame trap to burner 214 without adding significantly or appreciably to such restriction to air flow as is inherently present as a result of the small openings in the material of flame traps 229 and 230.

Ideally, each blocking plate 274 is the same or slightly larger size and shape as the respective flame trap with which it is closely associated and has the purpose of stopping condensate or scaly particulate matter falling from above and occluding the pores of the mesh of flame traps 229 and 230.

Figure 16:
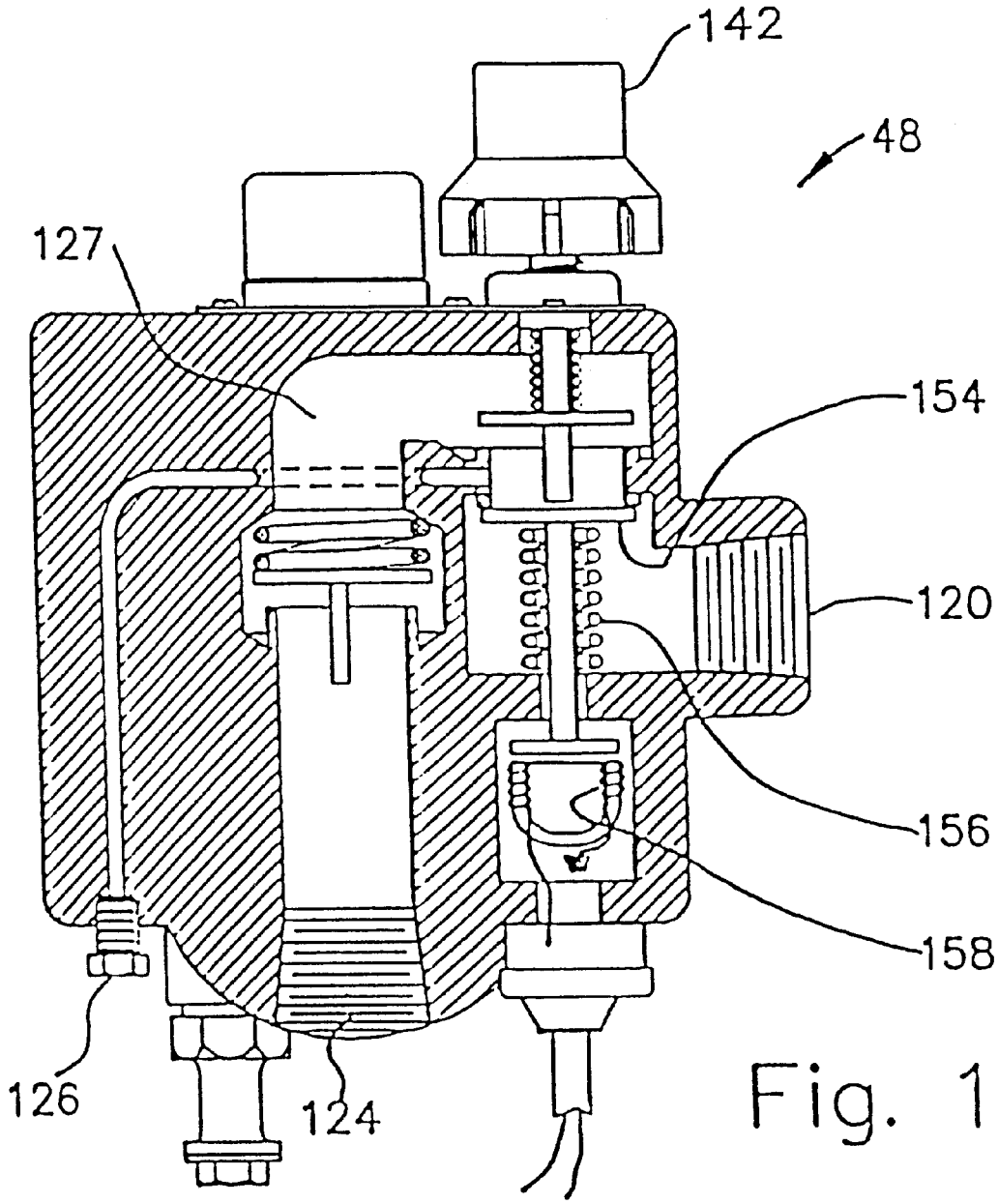
FIG. 16 is a cross-sectional view of the gas valve shown in FIGS. 11–13.
Figure 19:
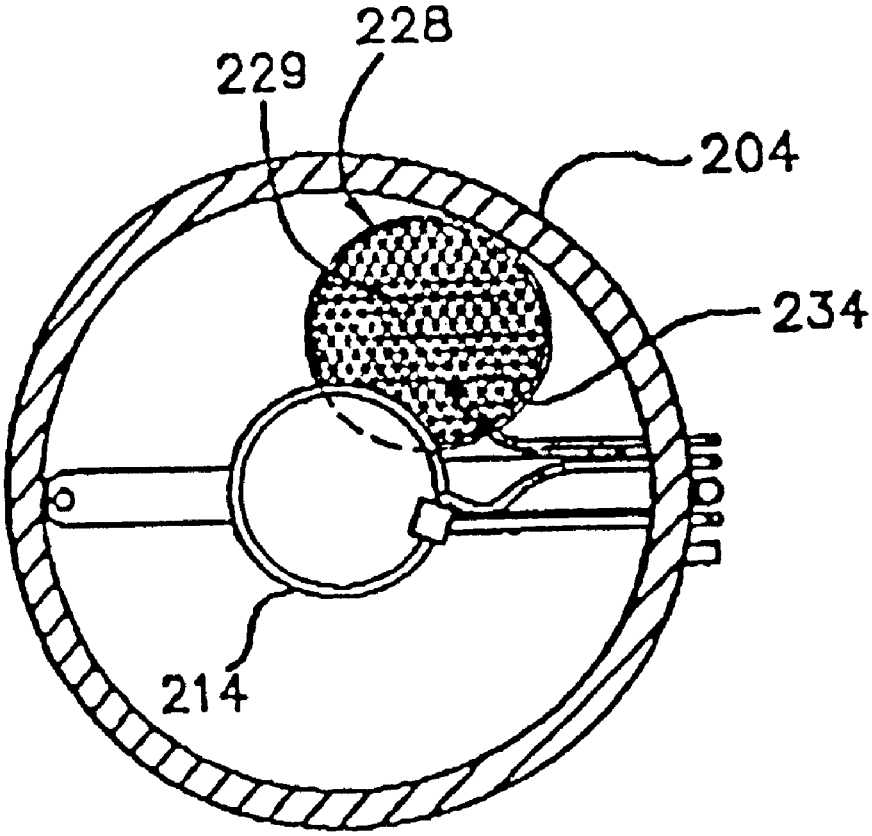
FIG. 19 is a cross-sectional view of a water heater similar to FIG. 18 except that it has a single large flame trap and no air duct.
Figure 21:
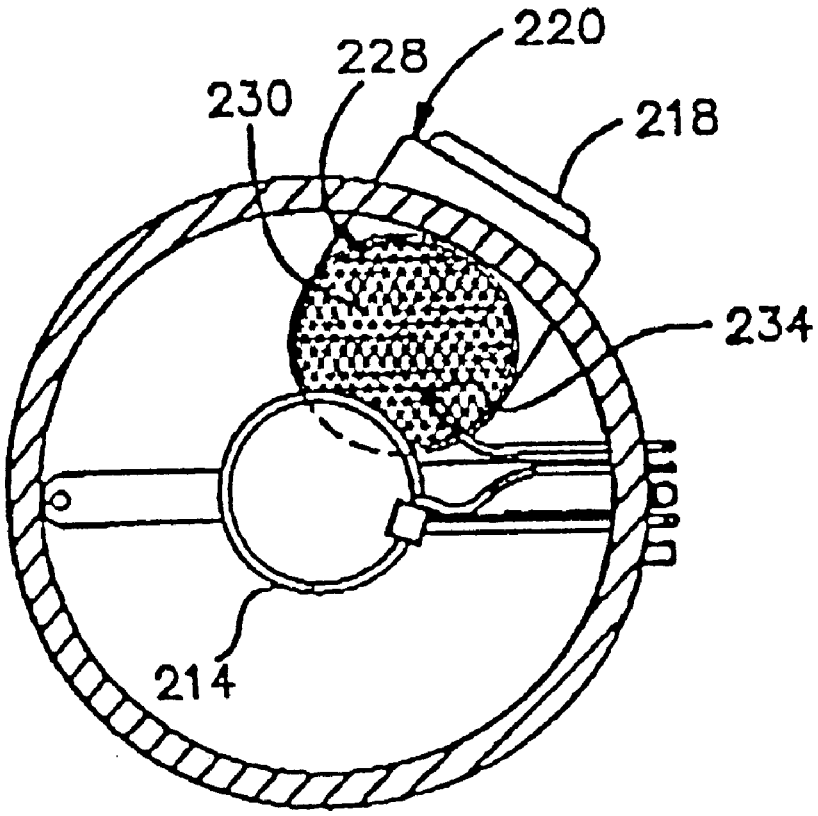
FIG. 21 is a cross-sectional view of the water heater of FIG. 20 taken through the line XXI—XXI.

As best seen in FIGS. 18, 19 and 21, each flame trap 229 and 230 has mounted on or adjacent its upward facing surface a thermally sensitive fuse 234 in series in an electrical circuit with the pilot flame proving thermocouple 251 (see FIG. 17) and a solenoid coil 158 (see FIG. 16) in gas valve 248. This electrical circuit is electrically equivalent to the arrangement described in FIGS. 11 and 15 but in this case varying the location of the thermally sensitive fuse 234 as follows:

Since for the water heaters shown in FIGS. 17, 18 and 19 air for combustion can only enter the combustion chamber through apertures 228 in base 226 of those embodiments rather than the aperture in the vertical wall as in embodiments such as shown in FIG. 9, then locations of a thermally sensitive fuse as indicated by numeral 134 in FIG. 10 would be ineffective in the constructions shown in FIGS. 17 and 18. Therefore, in FIGS. 17–21, each flame trap upper surface has associated with it in close proximity a heat-sensitive fuse 234 intended to quickly become permanently open-circuited in the event that flame burns on or around flame trap 229 and/or 230. Such flame would be indicative of an abnormal combustion event in two types of circumstances:

1. spilt fuel fumes or vapors entering flame trap 229 and/or 230 from the water heater surroundings;
2. during normal main burner 214 operation flames from the main burner extending downwardly toward the source of available air in the event of abnormal blockage of the normal air intake path(s) tending to starve main burner 214 of air for combustion (starvation of air for combustion may occur in the event that the flame trap(s) become blocked by lint, or if other material, such as clothes or rags are placed against the water heater around the air intakes or base; or
3. in the event of flue blockage.

In either case, the thermally sensitive fuse 234 is intended to become open circuited if impinged upon by flame and so cause the gas supply to the main and pilot burners to be shut off pending intervention by a knowledgeable service person.

Figure 20:
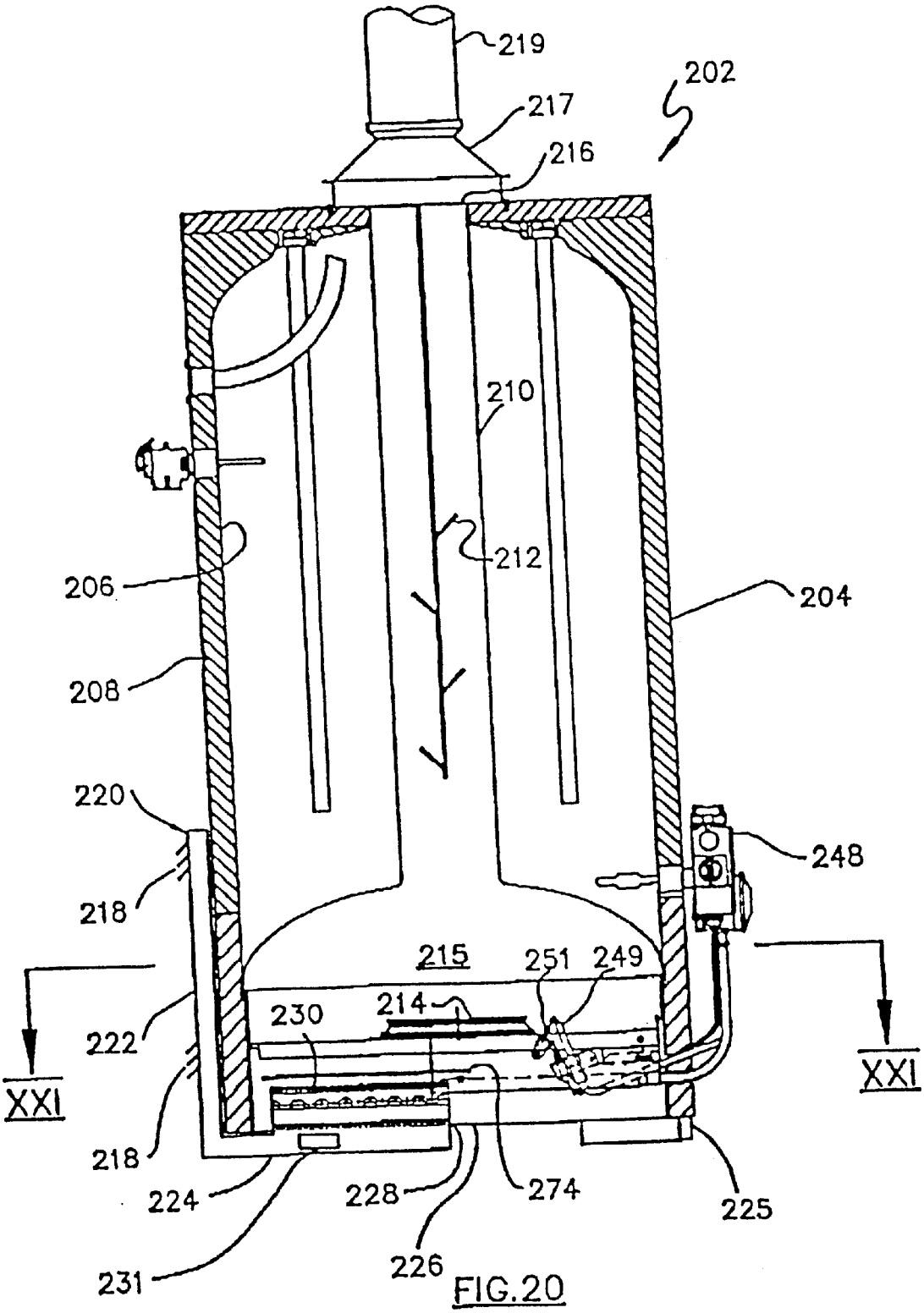
FIG. 20 is a schematic partial cross-sectional view of a gas water heater embodying still further aspects of the invention.

With reference to a further advantageous structure of the invention, FIG. 19 and related FIG. 20 are generally similar to the embodiment earlier illustrated and described in relation to FIGS. 9 and 10, the differences in this case being that (a) the single flame trap 229 is appreciably larger than that shown in FIGS. 9 and 10;

(b) there is no air entry point to combustion chamber 215 provided other than through that single larger flame trap 229, the side wall air entry apparent in FIG. 9 being absent in FIG. 20;

(c) the gas pipes and electrical wiring sheaths, where they pass through the vertical wall of jacket 204, are sealed gas tightly; and (d) a heat-sensitive fuse 234 is positioned over the flame trap analogously to that described in relation to FIGS. 17 and 18.

With reference to FIG. 19, the larger diameter of flame trap 229 as compared with that shown in FIGS. 9 and 10 is dependent upon the air consumption requirement for proper combustion to meet mandated specifications to ensure low pollution burning of the gas fuel. Merely by way of general indication, the flame trap 30 of FIGS. 9 and 10 would be conveniently about 135 mm diameter when fitted to a water heater having a 35 megajoule (MJ) energy consumption rating to meet US requirements for overload combustion when the other path for air entry (duct 22 in FIG. 9) is included. In the case of the embodiment shown in FIG. 19, however, where the entire air consumption requirement for burner 214 enters through flame trap 229, a diameter of the flame trap of about 175 mm is necessary to meet the same pollution avoiding standards imposed by USA authorities for a 35 MJ rated water heater.

With reference to FIGS. 20 and 21, an embodiment is shown analogous in all respects to FIGS. 17 and 18, respectively, the difference essentially being the replacement of the two separate flame-trapped entries in FIGS. 17 and 18 by one single larger one in FIGS. 20 and 21. With particular reference to FIG. 20, an additional small entry hole 231 is provided low in the horizontal duct portion 224 of the air duct assembly 220 to enable a minor percentage of consumed air to be "sampled" very close to floor level. An indicative estimate of the proportion of consumed air entering the combustion chamber 215 through opening 231 is about 10 to 20% of the total requirement. The purpose of this sampling opening 231 at low level is to enable spilt flammable vapors or fumes to enter via the opening 231 and to be ignited safely on the upper surface of the flame trap 230 whereupon sensing of the presence of that flame by temperature sensor 234 will lead to the prompt shutting down of gas flow through gas flow controller 248 so that no further source of ignition is provided by either pilot burner 249 or main burner 214 in combustion chamber 215.

Further advantageous embodiments of the invention are described below in relation to FIGS. 22*a* and 22*b* and those following. The embodiments in FIGS. 22 to 26 are particularly advantageous in situations where it is desired that water heaters according to the invention do not function to consume substantial quantities of spilt fuel but rather to prevent all combustion associated with the water heater, leaving spilt flammable vapours or fumes to be dispersed by ventilation rather than controlled combustion in the combustion chamber.

One important reason why this may be a preferred option is that if a considerable amount of spilt flammable vapour is available to be consumed, then the flame established on the flame trap porous surface inside the combustion chamber of the water heater could last long enough to substantially heat the conductive flame trap material so that the side of it exposed to the source of flammable vapours ("upstream" side) may become sufficiently heated to reach the auto-ignition temperature of the particular spilt vapour such that the vapour could be ignited outside the water heater without actual transference of flame through the flame trap. The embodiments shown in FIGS. 22 to 26 address this unlikely but potential difficulty according to several broad strategies.

The first such strategy involves mechanical devices which operate to starve flames established on the flame trap surface of air for continuing combustion triggered to operate by the heat of the flame burning on the face of the flame trap in the combustion chamber.

The second strategy is to extinguish flames established on the flame trap quickly by a combined chemical and physical reaction to the heat of the flame trap by generating, releasing and propelling a flame extinguishent substance into the intake of the flame upstream of the flame trap.

The third strategy involves selecting specific flame trap materials and coating them with an ablative substance that, when subjected to heat of combustion of spilt flammable vapours on the "downstream" surface of the flame trap, expands to occlude the pores of the flame trap thereby extinguishing the flame.

The fourth strategy is to select a thick, low heat conductive flame trap material such that heating at the downstream surface of the flame trap results in a much longer or infinite period before the temperature on the upstream face of the flame trap could reach a temperature able to cause ignition of the spilt vapours upstream of the flame trap entry.

Figure 22A:
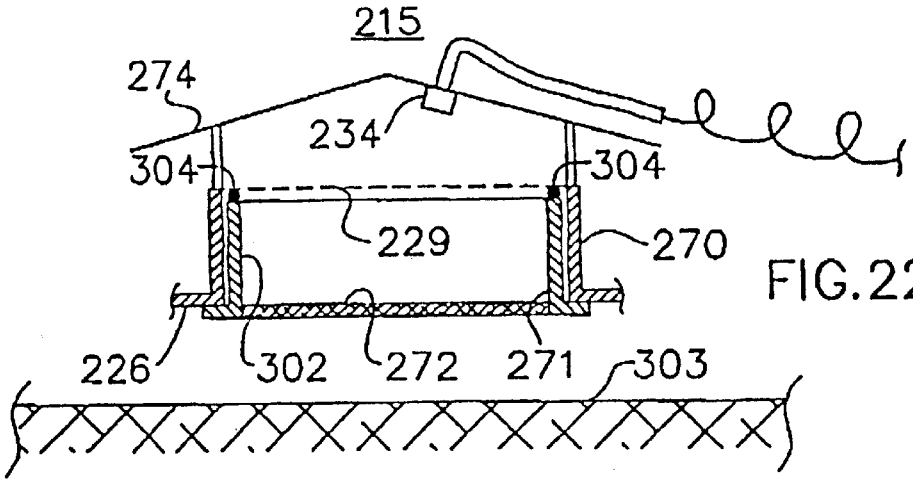
FIG. 22*a* is a schematic elevation, taken partly in section, of a portion of the bottom end of a water heater of the type shown in FIGS. 14 or 20 including further means for dampening combustion.

With reference to FIG. 22*a*, base 226 of the water heater has an aperture to which an upstanding tube 270 is joined, the tube terminating approximately 5 cms above the base to create a hole spanned by a flame trap 229. Above tube 270 and flame trap 229 is a substantially horizontal blocking plate 274 which may be conical or curved such as to be able to deflect any condensation water falling upon its upper surface outwardly beyond the flame trap area. Fixed to the underside of horizontal blocking plate 274 is a temperature sensitive fuse 234 connected to the gas valve 248 (see, for example FIG. 17) arranged to enable flow of gas through the gas valve to be shut off in the event of fuse 234 being open circuited by formation of a flame on the upper surface of the flame trap. A drop tube 302 is provided to create a smooth sliding fit inside the tube 270. The area enclosed by the blocking plate 274, the upstanding tube 270, and the drop tube 302 is a plenum 228. The opening 271 provides access to receive air into the plenum 228. Drop tube 302 is held in the upward position illustrated in FIG. 22*a* by a ring of fusible sealant 304 which acts as a hot melt adhesive to support tube 302 for normal operation in an upward position. Fusible sealant 304 most preferably has a melting temperature of about 100–200° C.

Opening 271 in the drop tube 302 may be spanned by a lint filter 273 if desired. As shown in FIG. 22*b* in the event of a flame forming on flame trap 229 the fusible sealant 304 melts allowing drop tube 302 to fall until it reaches a flat surface such as a floor or mating stop 303 upon which the heater is installed. The distance between the floor 303 and the base 226 of the heater must be not more than the vertical height of drop tube 302 so that, as illustrated, there is no space for sufficient air to enter the tube 270 to enable combustion of spilt flammable vapour or fumes inside combustion chamber 215. Therefore, the establishment of combustion on the upper surface of the flame trap effectively triggers the falling of drop tube 302, which substantially closes opening 271 and thereby starves the flame of any further vapour or fumes and air and extinguishing it.

Figure 22B:
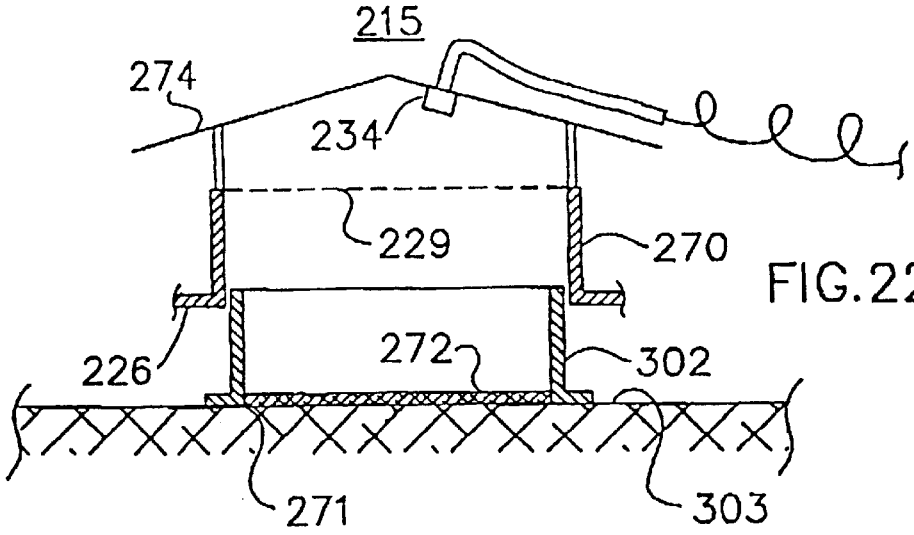
FIG. 22*b* shows the fire extinguishing means of FIG. 22*a* following actuation in the event of combustion on the flame trap illustrated.
Figure 23A:
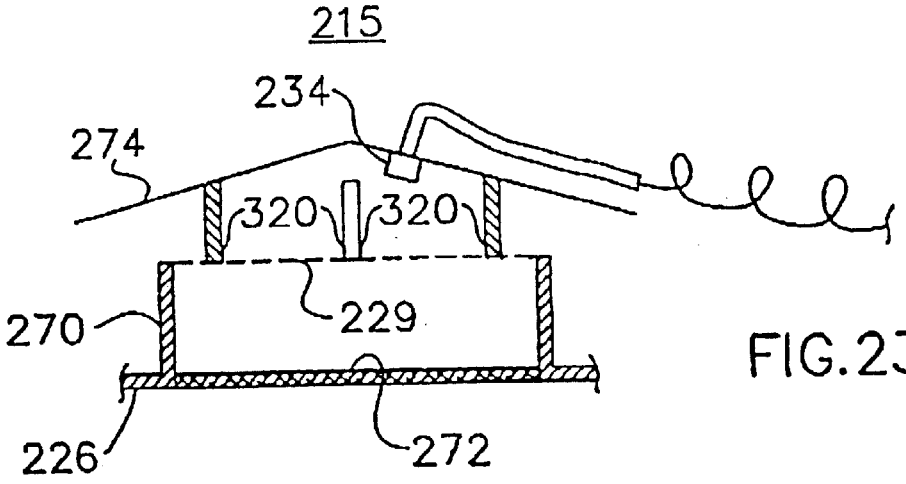
FIG. 23*a* is a further embodiment of a means for extinguishing fire similar to that shown in FIG. 22*a*.
Figure 23B:
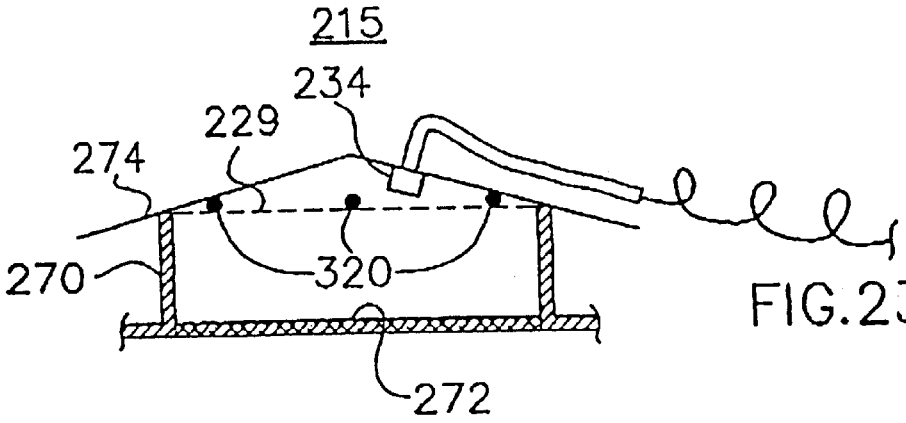
FIG. 23*b* shows the fire extinguishing means of FIG. 23*a* following actuation in the event of combustion on the flame trap.

A different arrangement performing a similar function to that shown in FIGS. 22*a* and 22*b* is provided in FIGS. 23*a* and 23*b*. In this case a horizontal blocking plate 274 is supported above flame trap 229 (FIG. 23*a*) by three legs 320 made from readily fusible material, preferably a thermoplastic material such as low density polyethylene. The readily fusible material most preferably has a melting temperature of 100–200° C. Of course, other readily fusible materials may be substituted. With this arrangement, in the event that combustion of spilt flammable vapour or fumes occurs on the flame trap 229, legs 320 melt as shown in FIG. 23*b* so that horizontal blocking plate 274 falls onto the top of tube 270, thus blocking the flow of further vapour or fumes and air to continue combustion, thereby extinguishing combustion.

Figure 24:
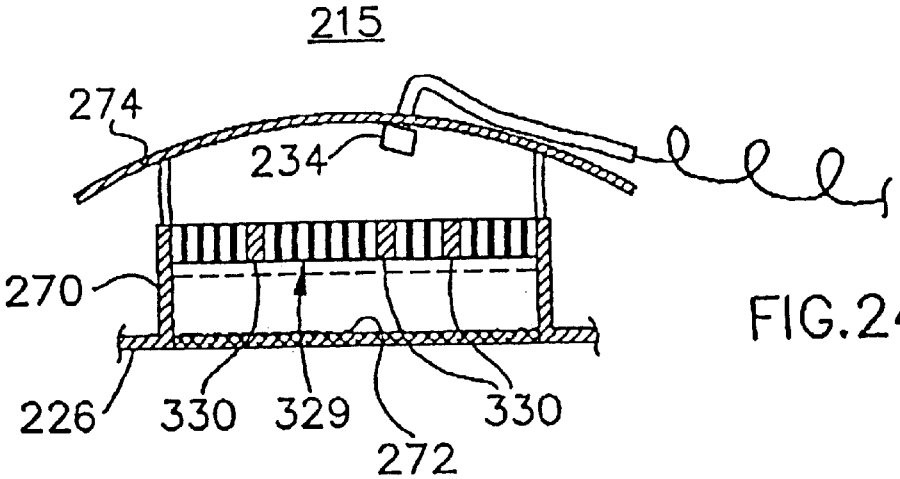
FIG. 24 is a detailed schematic elevation, taken partly in section, of a bottom end portion of a water heater of the type shown in FIGS. 14 or 20 substituting a different type of flame trap.

With reference to FIG. 24, an alternative type of flame trap material 329 is illustrated. The flame trap 329 may be in a number of forms, the common feature of which is a much greater dimension in the direction of through flow of air or fumes than previously disclosed in the illustrated embodiments. The main purpose of the thicker flame trap material 329 is to delay and/or reduce the conduction of heat from the top surface of flame trap 329 to the underside of flame trap 329 in the event of combustion being established due to flammable fumes and vapour igniting on the upper surface of flame trap 329. One type of flame trap is constructed of stainless steel foil, which is corrugated and joined to an uncorrugated strip of stainless steel foil of similar thickness and the first and second tapes joined together and spirally wound as disclosed in Hayakawa et al, U.S. Pat. No. 5,588,822. Then, the time taken for the inlet side of the flame trap to become heated to a temperature sufficient to ignite flammable vapours external to the water heater is considerably increased. This configuration can be rearranged if the overall shape of the flame trap is other than circular.

Even longer delay times are provided when the flame trap material 329 is constructed of ceramic materials such as Celcor (registered trade mark of Corning Incorporated of Houghton Park, Corning, N.Y. 14831) extruded ceramic having a thickness of about 12 mm or greater being preferred. It is preferably provided with an open frontal area between about 64 and 80% and with between about 36.6 and 73 square openings/cm$^2$. Flame trap 329 may be in any desired shape and may be built up to a total required area by using smaller modules of the ceramic material. Adjacent modules of ceramic can be sealed to each other using a flexible sealant 330 or the like as required.

Figure 25:
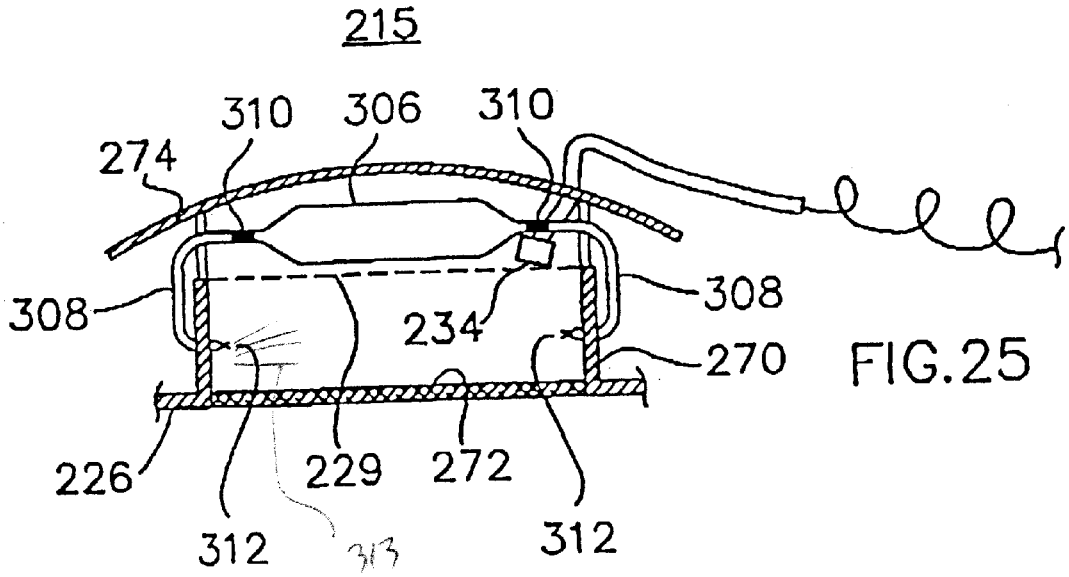
FIG. 25 is a detailed schematic elevation, taken partly in section and similar to FIGS. 22 to 24, including a heat actuated chemical fire extinguishing means operative with the flame trap.

With reference to FIG. 25, an alternative means of extinguishing flames on flame trap 229 is shown. Support tube 270, water heater base 226 and optional lint filter 272 are as previously illustrated as in FIG. 23. Flame trap 229 may be made from any of the materials as herein mentioned. Additional structure in FIG. 25 comprises a container 306 charged with a substance 313 capable of extinguishing flame which is restrained from leakage by fusible plugs 310 inserted in one or more outlets 308 to the container. Ends of the tubes 308 distant from the attachment to the container 306 may terminate in nozzles 312 to increase the mixing of flame extinguishent from the nozzles. Flame extinguishent 313 in container 306 may comprise one or more of many known substances decomposable under the effect of elevated temperature occasioned by the formation of flames on the flame trap 229 including, for example sodium bicarbonate. Sodium bicarbonate decomposes under the effect of elevated temperature to give off carbon dioxide gas which when mixed into the air stream, including flammable vapour entering the open end of tube 270, is able to extinguish flames on the upper (or inside) surface of the flame trap 229. Whilst the fusible plug or plugs 310 closing container 306 may have quite a wide range of suitable fusing temperatures, it is preferred that the range be sufficiently high so that fuse 234 is more likely to open the circuit and, therefore, shut off the gas flow before fusible plug(s) 310 melt. Accordingly, a preferred melting temperature of the fusible plug(s) is in the range of about 150 to 300° C.

Thermal fuse 234 is positioned in such a way that the presence of container 306 does not impede the fuse's function of shutting down supply of fuel gas to the main and pilot burners as elsewhere illustrated. The flame extinguishent encapsulated in container 306 may include fire blanketing foams together with a propellent which, under the effect of a temperature attained (typically in the range of 300 to 500° C.) just above the flame trap when a flame is burning thereon, would create high vapour pressure to propel the flame suppressant foam out through the nozzles 312 and into the fume/air intake traveling upwardly through tube 270.

Figure 26:
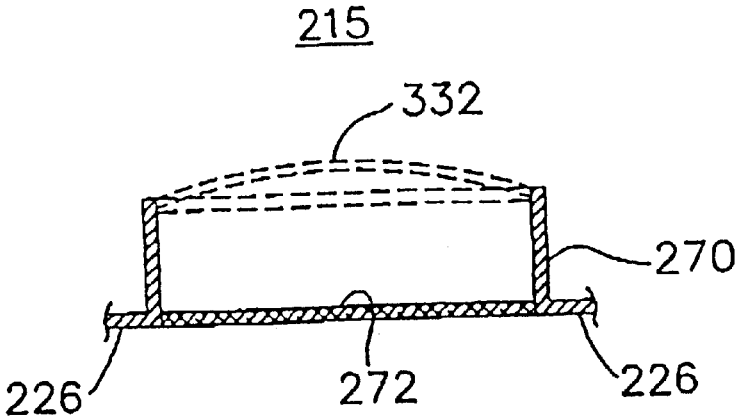
FIG. 26 is a detailed schematic elevation, taken in section and similar to FIGS. 22 to 24, including an embodiment of flame trap material arranged in two contacting layers.

With reference to FIG. 26, an alternatively shaped flame trap 332 is shown. Support tube 270, water heater base 226 and optional lint filter 272 are as previously illustrated, for example as in FIG. 23. With reference to the flame trap material 332, this comprises a double layer of woven metal mesh as previously described except that in FIG. 26 the two component layers are formed in a non-planar upwardly domed shape (for a circular aperture tube or an upwardly corrugated shape for a square or rectangular aperture at the top of tube 270). The advantage of the flame trap 332 over flat woven mesh constructions is that the two layers can be reliably manufactured substantially in contact and will remain substantially in contact because of the way they expand when so curved and do not form localized areas of contact between the two layers of mesh. A disadvantage obtaining with localized contact is that hot spots form quickly at such areas of contact and these might initiate ignition of unburned flammable fuels on the outside of the flame trap structure. Thus, the flame trap illustrated in FIG. 26 can safely sustain combustion on its upper surface for a greater length of time than a similar flat structure without causing ignition on the lower or outward side of the flame trap.

Whilst the above embodiments are directed to room or indoor installed gas water heaters, the improvements described will function in an outdoor environment, if spillages occur nearby and fumes enter the gas water heater.

The foregoing describes embodiments of the present invention and variations thereof and modification by those skilled in the art can be made thereto without departing from the scope of the invention. For example, the flame trap may be located at various positions other than those shown in the drawings and described above. One alternative position is in the side of the combustion chamber opposite the gas supply. In such a construction the flame trap would be located in an opening in the skirt below the water tank and extending through the corresponding portion of insulation.

In a further construction the flame trap is positioned above the height of entry to the combustion chamber and the flame sensitive switch is positioned above that height of entry in the flow path of combustion air toward the burner. The aperture covered by the flame trap is in radiant heat communication with a flame sensitive switch also positioned to be sensitive to flame roll out from flue blockage or combustion air starvation.

It is also possible that tube 70 as shown in FIG. 9 can be made either partially or completely from flame trap materials, especially the upper portion.

Further, the flame trap may be made from a variety of materials such as those described above, but can be fabricated from others not specifically identified so long as they permit passage of air and fumes in one direction but prevent flames from travelling in the opposite direction.

Suitable flame trap materials include those being porous, gas permeable and possessing sufficiently high thermal capacity to quench flame under typical conditions of use. Metallic structures having small holes, made from, for example, mild steel, stainless steel, copper or aluminum are suitable and porous ceramics including glass or mineral wool woven or non-woven constructions are also suitable. Fibre matrix ceramic is suitable as is flexible or rigid constructions.

Also, the air passage for combustion air, such as in the structure labelled 22 in FIG. 1, can be located between water tank 6 and jacket 4. The passageway can be of a variety of shapes and sizes and can be formed in and bounded by the insulation or can be formed by tubes, pipes conduits and the like.

It should also be understood that utilization of the flame sensitive switch or similar devices may be used with all types of gas fired water heaters, including those not equipped with flame traps. Further, devices other than thermocouples 51 providing electrical potentials may be employed so long as they are capable of converting heat energy to assist in actuating closure 154. Heat to mechanical, heat to optical, heat to magnetic and the like types of conversions are all within the scope of the invention. Accordingly, "signal" as used in the claims refers not only to "electrical potential" but to any means whereby closure 154 is actuated/deactuated as a result of detection of heat energy.

Main burner 14 and combustion chamber 15 can have different constructions such as those described in U.S. Pat. Nos. 4,924,816; 5,240,411; 5,355,841; and co-pending application Ser. Nos. 08/333,871 and 08/113,618, for example, the subject matter of which is incorporated herein by reference.

Duct 270 may be made from a number of heat and corrosion resistant materials, may be shaped and sized in different configurations, and can have flame trap 229 placed in any number of relative positions, including horizontal, vertical and at various angles.

Finally, it is possible that container 306 shown in FIG. 25 may be located in alternative positions within combustion chamber 215 or even exteriorly of the water heater so long as fusible material 310 and nozzles 312 are located adjacent flame trap 229, either above or below it.

What is claimed is:

1. A water heater comprising:

a water container;

a combustion chamber located adjacent said container;

a burner located inside said combustion chamber;

a flame trap positioned at an opening in said combustion chamber, said flame trap permitting ingress of combustion air and/or extraneous gases into said combustion chamber and preventing egress of flames from said water heater;

a plenum positioned upstream of said opening, through which said combustion air and/or extraneous gases flow to said combustion chamber and said plenum having an access opening to receive said combustion air and/or extraneous gases; and a lint filter positioned at said access opening in said plenum.

2. The water heater defined in claim 1, further comprising a pilot burner positioned above said plenum.

3. The water heater defined in claim 1, further comprising a pilot burner positioned above said flame trap.

4. The water heater defined in claim 3, wherein said plenum is tubularly shaped.

5. The water heater defined in claim 1, wherein said burner is positioned above said plenum.

6. The water heater defined in claim 1, further comprising a flue extending upwardly from the combustion chamber and through the water container.

7. The water heater defined in claim 1, wherein said burner is positioned above said flame trap.

8. The water heater defined in claim 1, further comprising a blocking plate positioned within said combustion chamber and spaced above said opening.

9. The water heater defined in claim 1, further comprising a heat sensor positioned within said combustion chamber and adjacent said flame trap and capable of shutting off fuel to said burner when the temperature in said combustion chamber adjacent said flame trap exceeds a predetermined temperature.

10. A water heater comprising:

a water container;

a combustion chamber located adjacent said container;

a burner located inside said combustion chamber;

a flame trap positioned at an opening in said combustion chamber, said flame trap permitting ingress of combustion air and/or extraneous gases into said combustion chamber and preventing egress of flames from said water heater;

a plenum positioned upstream from said opening and adapted to provide combustion air and/or extraneous fumes to said combustion chamber; and a lint filter located across an access opening in the plenum.

11. The water heater defined in claim 10, further comprising a pilot burner positioned above said plenum.

12. The water heater defined in claim 10, further comprising a pilot burner positioned above said flame trap.

13. The water heater defined in claim 10, wherein said plenum is tubularly shaped.

14. The water heater defined in claim 10, wherein said burner is positioned above said plenum.

15. The water heater defined in claim 10, further comprising a flue extending upwardly from the combustion chamber and through the water container.

16. The water heater defined in claim 10, wherein said burner is positioned above said flame trap.

17. The water heater defined in claim 10, further comprising a blocking plate positioned within said combustion chamber and spaced above said opening.

18. The water heater defined in claim 10, further comprising a heat sensor positioned within said combustion chamber and adjacent said flame trap and capable of shutting off fuel to said burner when the temperature in said combustion chamber adjacent said flame trap exceeds a predetermined temperature.

19. A water heater comprising:

a water container;

a combustion chamber located adjacent said container;

a burner located inside said combustion chamber;

a flame trap positioned at an opening in said combustion chamber, said flame trap permitting ingress of combustion air and/or extraneous gases into said combustion chamber and preventing egress of flames from said water heater; and a lint filter positioned across an opening in a plenum located upstream of said combustion chamber.

20. The water heater defined in claim 19, further comprising a pilot burner positioned above said plenum.

21. The water heater defined in claim 19, further comprising a pilot burner positioned above said flame trap.

22. The water heater defined in claim 19, wherein said plenum is tubularly shaped.

23. The water heater defined in claim 19, wherein said burner is positioned above said flame trap.

24. The water heater defined in claim 19, further comprising a blocking plate positioned within said combustion chamber and spaced above said opening.

25. The water heater defined in claim 19, further comprising a heat sensor positioned within said combustion chamber and adjacent said flame trap and capable of shutting off fuel to said burner when the temperature in said combustion chamber adjacent said flame trap exceeds a predetermined temperature.

26. The water heater defined in claim 19, wherein said burner is positioned above said plenum.

27. The water heater defined in claim 19, further comprising a flue extending upwardly from the combustion chamber and through the water container.

* * * * *

UNITED STATES PATENT AND TRADEMARK OFFICE

CERTIFICATE OF CORRECTION

PATENT NO. : 6,401,668 B2
DATED : June 11, 2002
INVENTOR(S) : Valcic

It is certified that error appears in the above-identified patent and that said Letters Patent is hereby corrected as shown below:

Column 1,
Line 16, after "Field of the Invention", please insert the following paragraph:
-- The present invention relates to ignition inhibiting gas fired water heaters, particularly to improvements to gas fired water heaters adapted to render them safer for use. --

Signed and Sealed this

Fifteenth Day of October, 2002

*Attest:*

*Attesting Officer*

JAMES E. ROGAN
*Director of the United States Patent and Trademark Office*